US007726166B2

(12) United States Patent
Kong

(10) Patent No.: US 7,726,166 B2
(45) **Date of Patent: *Jun. 1, 2010**

(54) MULTI-STEP PRESS SYSTEM

(75) Inventor: Moon-Gyu Kong, Anyang-si (KR)

(73) Assignee: GNS Co., Ltd. (KR)

( * ) Notice: Subject to any disclaimer, the term of this patent is extended or adjusted under 35 U.S.C. 154(b) by 568 days.

This patent is subject to a terminal disclaimer.

(21) Appl. No.: 11/715,052

(22) Filed: Mar. 7, 2007

(65) Prior Publication Data

US 2008/0216547 A1 Sep. 11, 2008

(51) Int. Cl.
*B21J 11/00* (2006.01)

(52) U.S. Cl. ..... 72/405.13; 72/405.01; 414/795.8; 414/796.9

(58) Field of Classification Search ..... 72/355.2, 72/358, 361, 446, 481.6, 481.7, 405.01–405.16; 198/621.1; 100/207, 918; 414/795.8, 796, 414/796.5, 796.6, 796.7, 796.9, 797, 797.1
See application file for complete search history.

(56) References Cited

U.S. PATENT DOCUMENTS

| | | | | |
|---|---|---|---|---|
| 5,121,623 | A | 6/1992 | Brzezniak | |
| 5,727,416 | A | 3/1998 | Allgoewer | |
| 6,000,327 | A * | 12/1999 | Moriyasu et al. | 100/207 |
| 6,105,414 | A | 8/2000 | Yamada et al. | |
| 6,200,245 | B1 | 3/2001 | Dodo et al. | |
| 6,691,544 | B2 * | 2/2004 | Steudle et al. | 72/164 |
| 7,562,551 | B2 * | 7/2009 | Kong | 72/405.13 |
| 2008/0216546 | A1 | 9/2008 | Kong | |

FOREIGN PATENT DOCUMENTS

| | | | |
|---|---|---|---|
| JP | 03-043959 | B2 | 4/1985 |
| JP | 07-100540 | A | 4/1995 |
| JP | 07-155874 | A | 6/1995 |
| KR | 10-1983-0001698 | A | 5/1983 |
| KR | 10-1999-0083488 | A | 11/1999 |
| KR | 10-0258712 | B1 | 12/2000 |
| KR | 10-0346866 | B1 | 11/2002 |
| KR | 10-2003-0060058 | A | 7/2003 |
| KR | 10-0550717 | B1 | 2/2006 |

OTHER PUBLICATIONS

Notice of Allowance Issued on May 11, 2009 of Related U.S. Appl. No. 11/715,126, filed March 7, 2007—12 pages.

* cited by examiner

*Primary Examiner*—Dana Ross
*Assistant Examiner*—Matthew G Katcoff
(74) *Attorney, Agent, or Firm*—Knobbe Martens Olson & Bear LLP

(57) ABSTRACT

A multi-step press system includes a press that consists of a press frame, a table provided on the press frame and a ram provided above the table for making movement in a Z-axis direction. The table has a standby station into which workpieces are loaded one by one and a plurality of press-forming stations in which the workpieces are sequentially press-formed. The system further includes a press die set consisting of a lower die attached to the table and an upper die attached to the ram. The lower die and the upper die are adapted to simultaneously press-form the workpieces placed in the press-forming stations. On one side of the press, there is provided a destacker for periodically loading the workpieces into the standby station. A transfer feeder is provided between the table and the ram for simultaneously picking up and transferring the workpieces.

13 Claims, 14 Drawing Sheets

MULTI-STEP PRESS SYSTEM

BACKGROUND

1. Field

The present invention relates to a multi-step press system and, more particularly, to a multi-step press system for simultaneously press-forming workpieces placed on a plurality of press-forming stations through a single pressing stroke.

2. Discussion of the Related Technology

A press refers to a machine for manufacturing products by shearing, forming and squeezing a material such as a metal plate, a plastic, a fiber and the like. The press is suitable for use in mass production of articles and finds extensive applications in a variety of industrial fields. Press die sets of varying structures are employed in the press for the purpose of cutting, punching, blanking, piercing, bending, drawing and embossing workpieces. Each of the press die sets includes an upper die attached to a ram of the press and a lower die secured to a table thereof. The press die sets are often called a punch, a cutter or other names depending on the functions performed by them.

Arrangements that achieve automatic workpiece loading and unloading operations for improvement of productivity in a press are disclosed in Korean Patent Registration Publication No. 10-346866 and U.S. Pat. No. 6,105,414. The arrangements taught in these prior art references are of the type capable of loading and unloading workpieces by the actuation of a transfer feeder.

However, these arrangements involve many difficulties in adapting themselves to a multi-step press system that sequentially loads workpieces into a plurality of press-forming stations and then press-forms them into final products. Specifically, there is a problem in that the transfer feeder for sequentially loading the workpieces into each of the press-forming stations is structurally complex. Another problem is that a lot of dead time is spent in loading and unloading the workpieces, which in turn leads to reduced manufacturing speed, low productivity and increased production costs.

In the meantime, there is known a multi-step press system whose press die is comprised of a plurality of transfer dies corresponding to press-forming stations, each of the transfer dies having a set of upper and lower die members. Such a press die arrangement is disclosed in Korean Patent Laid-open Publication No. 2000-70458 wherein an upper die member and a lower die member are removably attached to a die holder by means of a clamp. However, this poses a problem in that press die fabrication costs are increased due to the use of the die holder for clamping the upper die member and the lower die member. Another problem is that the task of attaching and removing the upper die member and the lower die member in individual press-forming stations are time-consuming, labor-intensive and costly.

The discussion in this section is to provide general background information, and does not constitute an admission of prior art.

SUMMARY

An aspect of the present invention provides a multi-step press system that can simultaneously press-form workpieces placed on a plurality of press-forming stations through a single pressing stroke, thereby improving productivity and sharply reducing production costs.

Another aspect of the present invention provides a multi-step press system capable of press-forming workpieces by sequentially loading the workpieces into a plurality of press-forming stations in an accurate and smooth manner.

A further aspect of the present invention provides a multi-step press system that allows a plurality of die segments forming an upper die and a lower die of a press to be readily attached and removed in a cartridge-like manner, thereby shortening the die change time, enhancing the ease of work and the interchangeability of components, helping to shorten the time period required in developing and designing the press die set, and reducing the production costs.

A still further aspect of the present invention provides a multi-step press system that enables workpieces to be press-formed in a blank condition or a coiled condition, thus helping to attain an optimized flexible manufacturing system.

One aspect of the present invention provides a multi-step press system comprising: a press including a press frame, a table provided on the press frame, the table having a standby station into which workpieces are loaded one by one and a plurality of press-forming stations in which the workpieces are sequentially press-formed, the standby station and the press-forming stations being serially arranged in an X-axis direction, and a ram provided above the table for making rectilinear reciprocating movement in a Z-axis direction; a press die set including a lower die attached to the table and an upper die attached to the ram, the lower die and the upper die being adapted to simultaneously press-form the workpieces placed in the press-forming stations; a destacker provided on one side of the press for periodically loading the workpieces into the standby station one by one; and a transfer feeder provided between the table and the ram for simultaneously picking up the workpieces placed in the standby station and the press-forming stations and transferring the workpieces in a downstream direction.

BRIEF DESCRIPTION OF THE DRAWINGS

The above and other aspects and features of the present invention will become apparent from the following description of embodiments, given in conjunction with the accompanying drawings, in which.

DETAILED DESCRIPTION OF EMBODIMENTS

Hereinbelow, various embodiments of a multi-step press system in accordance with one embodiment of the present invention will be described with reference to the accompanying drawings.

Figure 1:
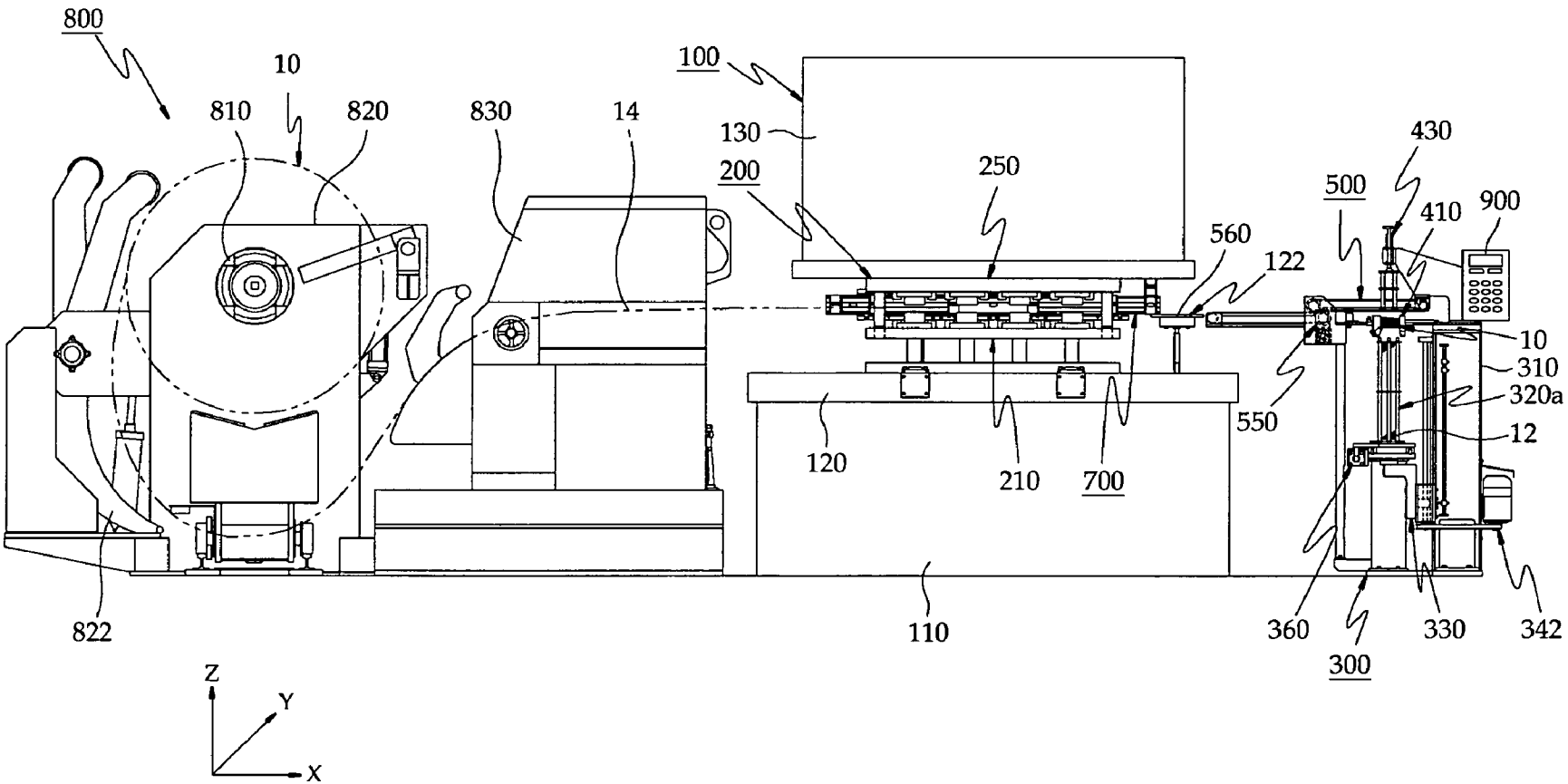
FIG. 1 is a front elevational view showing the overall configuration of a multi-step press system in accordance with one embodiment of the present invention.
Figure 2:
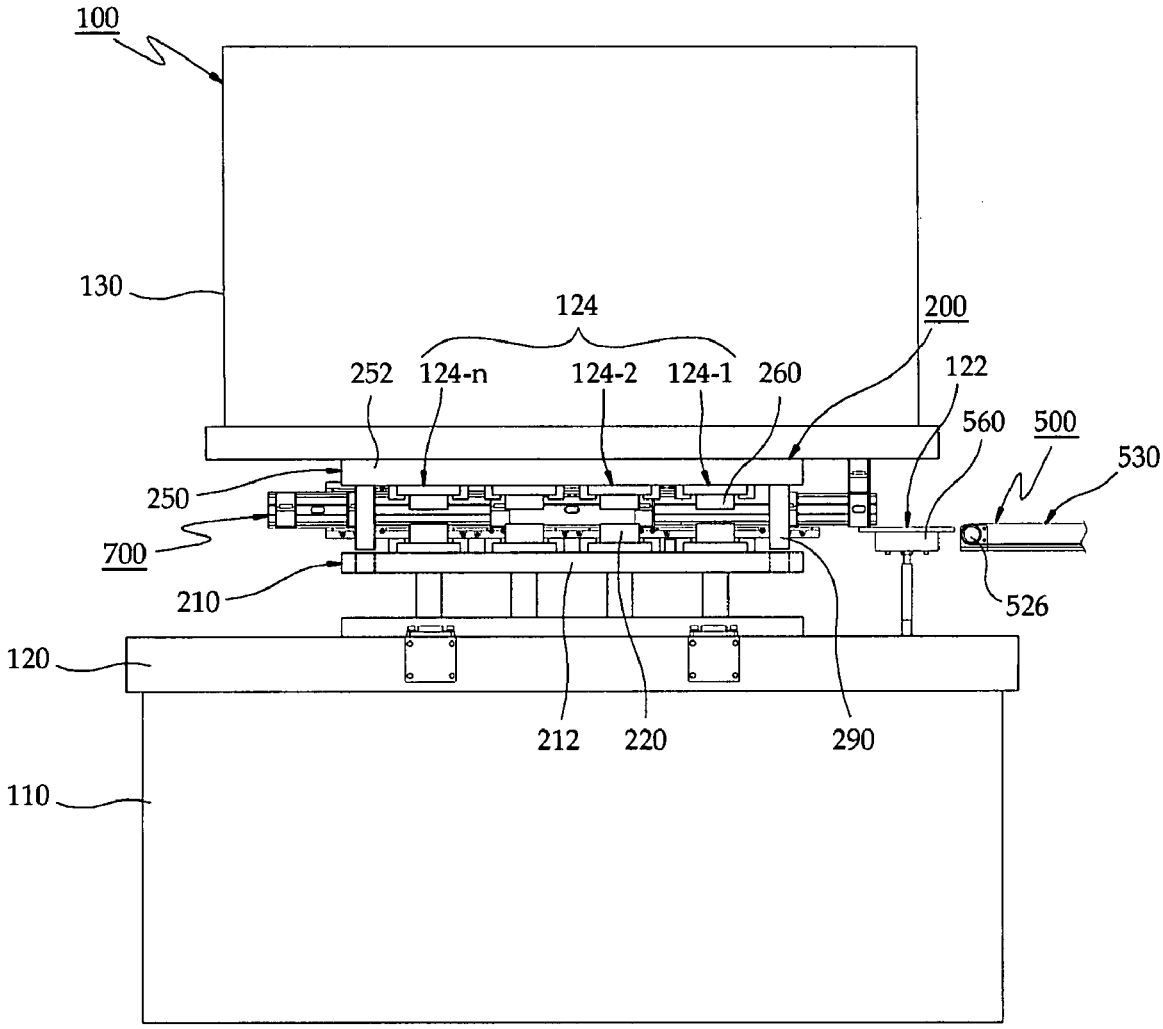
FIG. 2 is a front elevational view illustrating a press, a press die set and a transfer feeder employed in the present press system.
Figure 3:
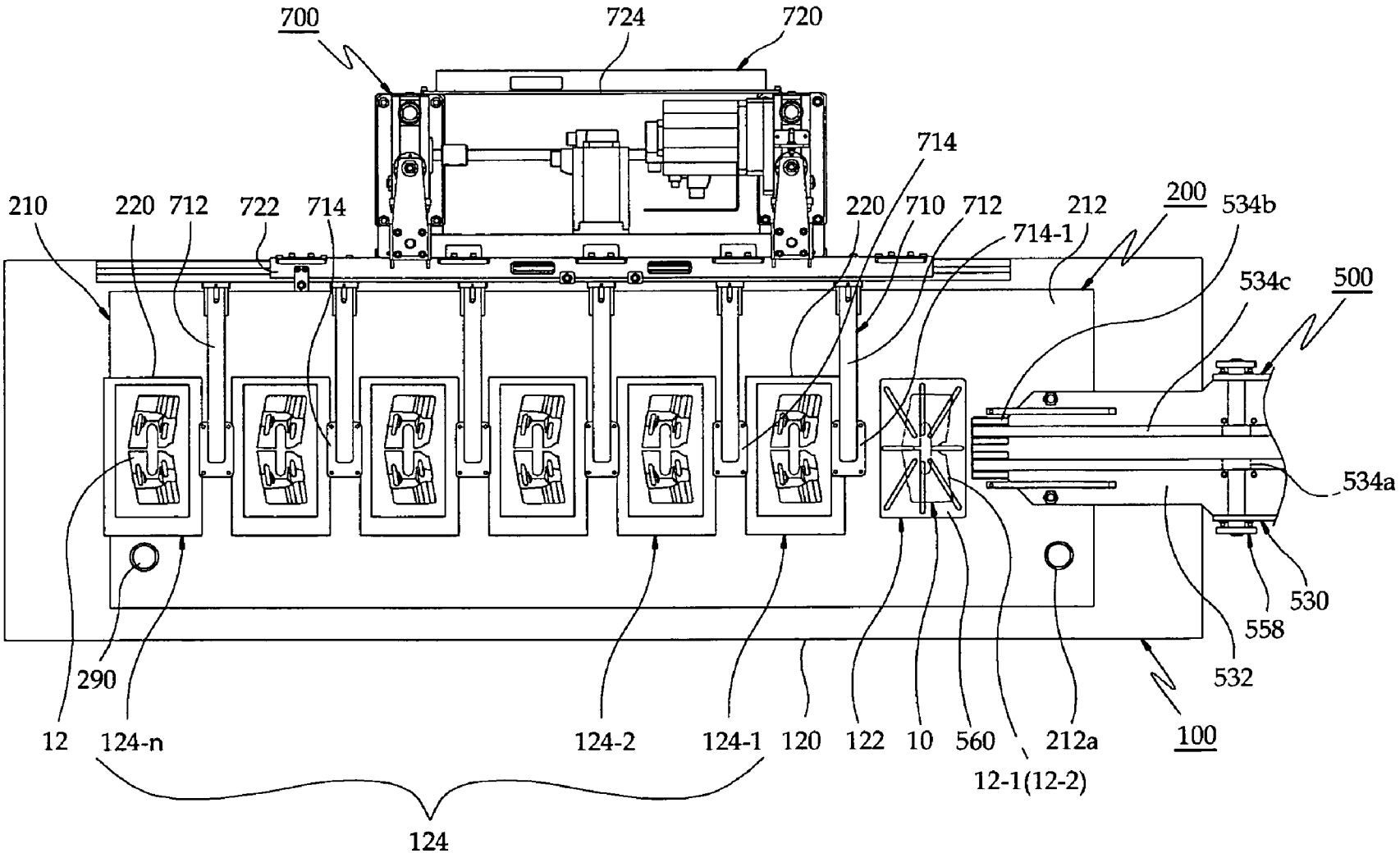
FIG. 3 is a top view illustrating the press, the press die set and the transfer feeder employed in the present press system.

Referring first to FIGS. 1 to 3, a multi-step press system according to one embodiment of the present invention includes a single press 100. The press 100 is comprised of a press frame 110 serving as an outer shell, a table 120 attached to the press frame 110 and a ram 130 provided above the table 120 for rectilinear reciprocating movement in a Z-axis direction with respect to the table 120. Serially arranged on the table 120 in an X-axis direction are a standby station 122 into which workpieces 10 can be loaded one by one and a plurality of press-forming stations 124(124-1 to 124-n) in which the workpieces 10 can be processed step by step into desired products.

For the purpose of processing blank workpieces 12 as one example of the workpieces 10, the standby station 122 is arranged on the table 120 so that it can lie adjacent to the upstream side of a first upstreammost press station (124-1) among the press-forming stations. 124. The press 100 may be a well-known mechanical press in which the rectilinear reciprocating movement in the Z-axis direction of the ram 130 is caused by means of a drive mechanism including a crank, an eccentric, a toggle, a link, a cam and the like. Alternatively, the press 100 may be a well-known hydraulic press that relies upon a fluid pressure to cause the ram 130 to make rectilinear reciprocating movement in the Z-axis direction.

Referring to FIGS. 1 through 6, a lower die 210 and an upper die 250 of a press die set 200 are respectively attached to the table 120 and the ram 130 of the press 100 and are used in the multi-step processing of the workpieces 10 loaded into the press-forming stations 124. The lower die 210 has a base 212 bolted to the top surface of the table 120. A plurality of guide holes 212*a* and a plurality of mounting holes 212*b* are formed in the base 212 of the lower die 210.

Figure 4:
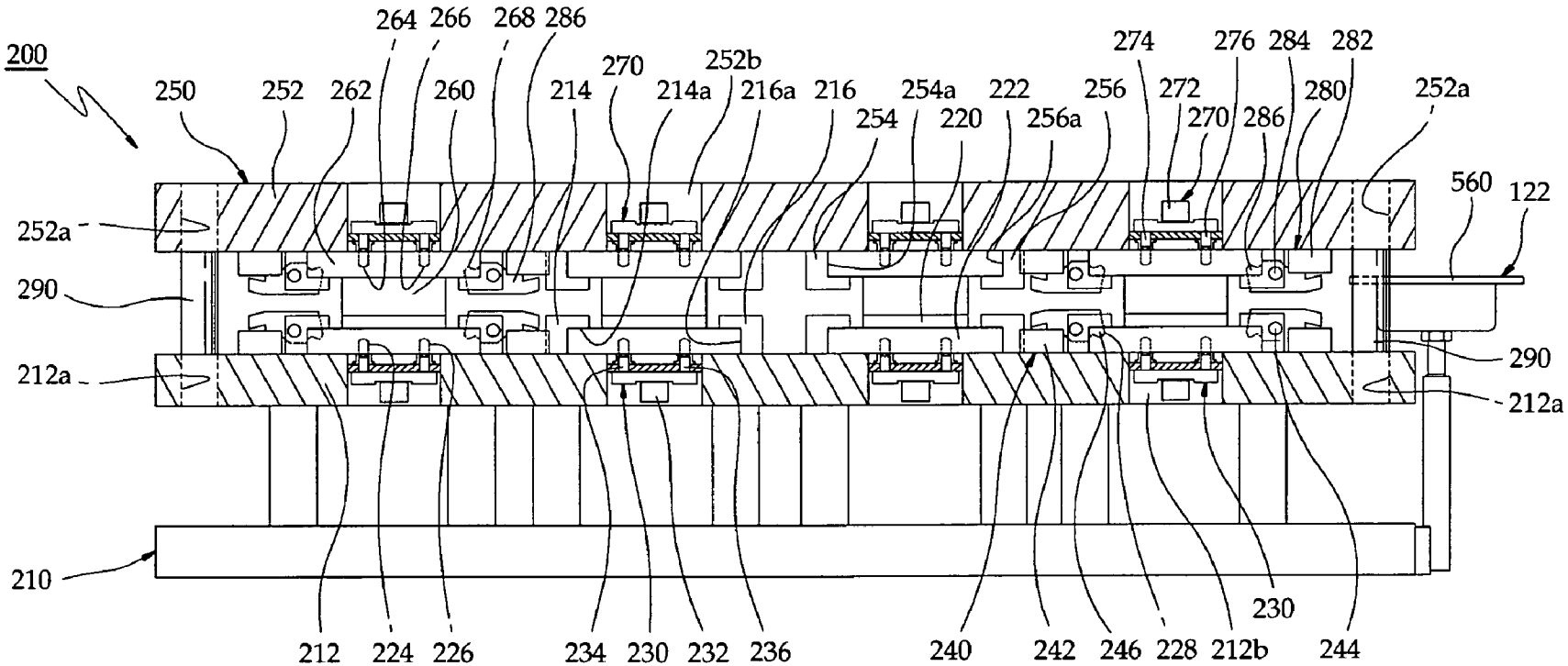
FIG. 4 is a sectional view showing the press die set employed in the present press system.
Figure 5:
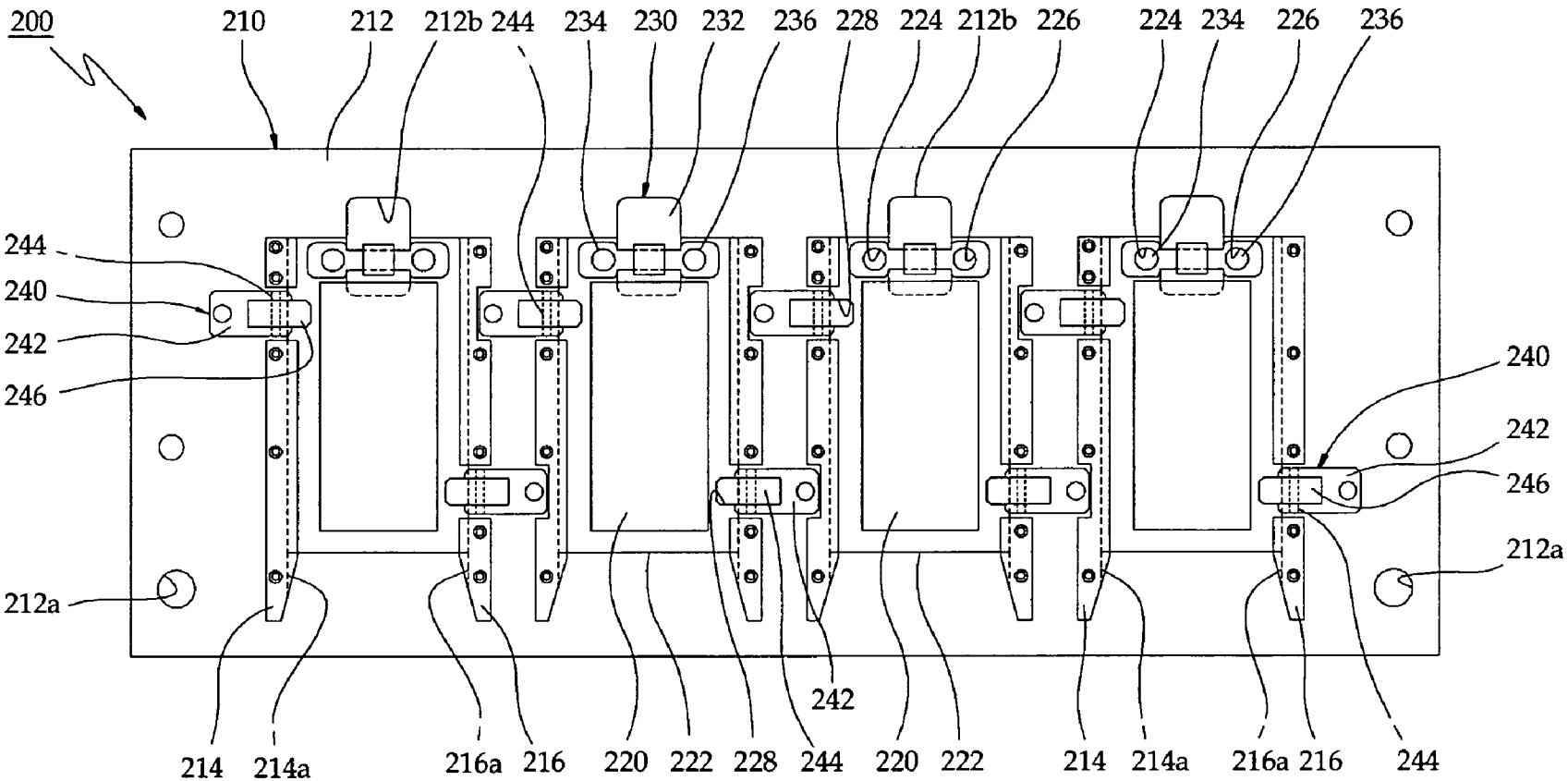
FIG. 5 is a top view depicting a lower die of the press die set employed in the present press system.

As can be seen in FIGS. 4 and 5, plural pairs of guide rails 214 and 216 are fixedly secured to the top surface of the base 212 along a Y-axis direction, each pair of guide rails 214 and 216 having mutually opposing grooves 214*a* and 216*a*. A plurality of die segments 220 for making direct contact with the workpieces 10 to press-form the workpieces into desired shapes are removably attached to each pair of guide rails 214 and 216. Each of the die segments 220 has a slider plate 222 slidingly fitted into the grooves 214*a* and 216*a* of each pair of guide rails 214 and 216. The slider plate 222 has locator holes 224 and 226 in its rear end region and clamping holes 228 in its lateral side regions.

A plurality of locators 230 for aligning the positions of the die segments 220 are mounted at the rear of the respective pairs of guide rails 214 and 216. Each of the locators 230 includes an actuator 232 arranged inside each of the mounting holes 212*b* of the base 212 and a plurality of locator pins 234 and 236 provided such that they can be extended through the mounting holes 212*b* of the base 212 by virtue of the actuator 232 and fitted into locator holes 224 and 226 of the die segments 220. The actuator 232 may be a pneumatic type or an electric type.

On the opposite lateral sides of the respective pairs of guide rails 214 and 216, there are arranged clamping units 240 for clamping the die segments 220 against removal. Each of the clamping units 240 includes an actuator 242 mounted to the base 212 and a clamp 246 adapted to rotate about a pivot pin 244 by means of the actuator 242 and then to engage with the clamp holes 228 of the slider plate 222, thereby clamping the corresponding one of the die segments 220.

Figure 6:
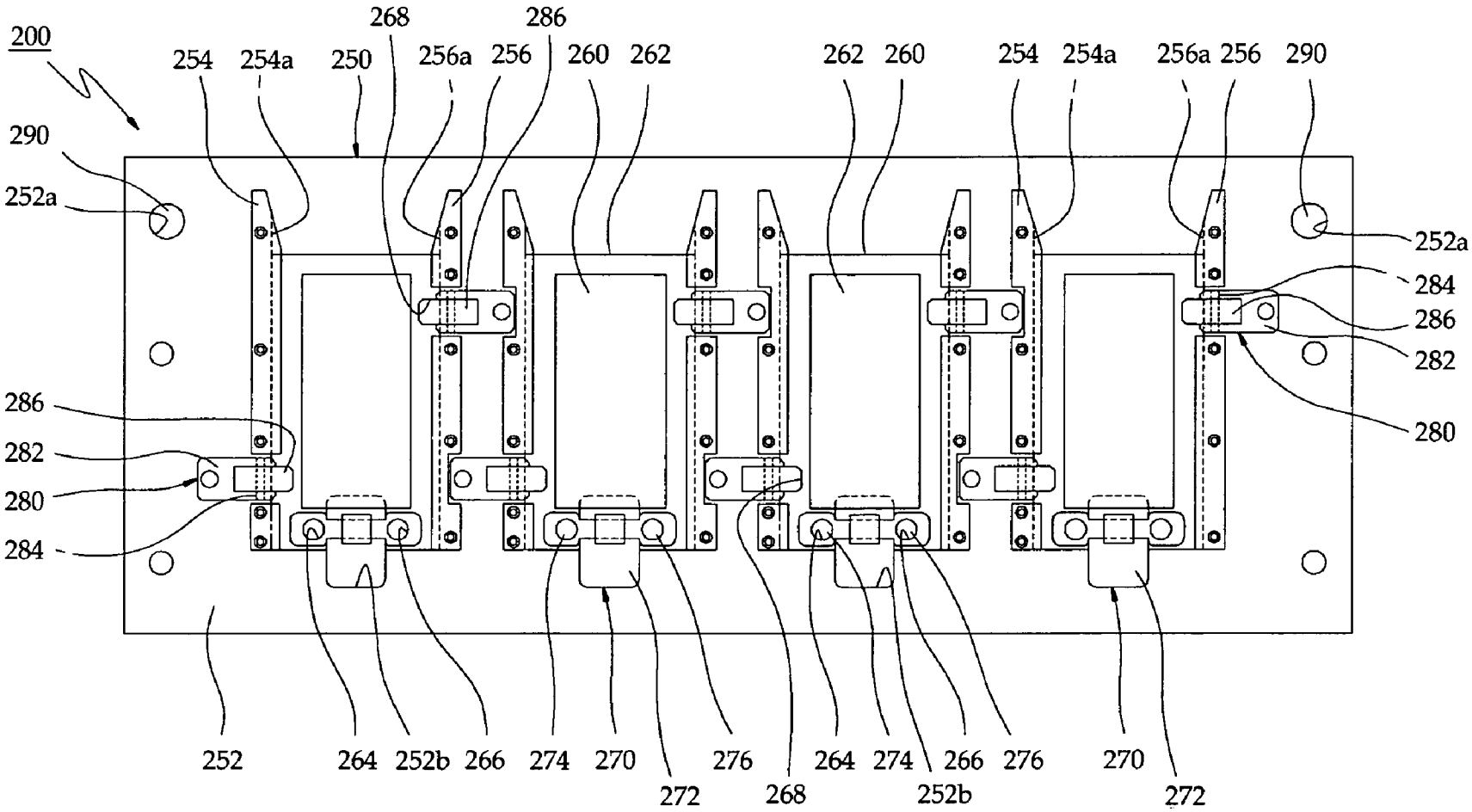
FIG. 6 is a bottom view depicting an upper die of the press die set employed in the present press system.

As shown in FIGS. 4 and 6, the upper die 250 is attached to the bottom surface of the ram 130 in an opposing relationship with the lower die 210. The upper die 250 includes a base 252, plural pairs of guide rails 254 and 256, locators 270 and clamping units 280, all of which correspond in configuration to the base 212, the guide rails 214 and 216, the locator 230 and the clamping units 240 of the lower die 210.

The base 252 of the upper die 250 is bolted to the bottom surface of the ram 130 and has guide holes 252*a* and mounting holes 252*b*. Plural pairs of guide rails 254 and 256 are fixedly secured to the bottom surface of the base 252 along a Y-axis direction, each pair of guide rails 254 and 256 having mutually opposing grooves 254*a* and 256*a*. A plurality of die segments 260 for making direct contact with the workpieces 10 to press-form the workpieces into desired shapes are removably attached to the guide rails 254 and 256. Each of the die segments 260 has a slider plate 262 slidingly fitted into the grooves 254*a* and 256*a* of each pair of guide rails 254 and 256. The slider plate 262 has locator holes 264 and 266 in its rear end region and clamping holes 268 in its lateral side regions.

Furthermore, a plurality of locators 270 for aligning the positions of the die segments 260 are mounted at the rear of the respective pairs of guide rails 254 and 256. Each of the locators 270 includes an actuator 272 arranged inside each of the mounting holes 252*b* of the base 252 and a plurality of locator pins 274 and 276 provided such that they can be extended through the mounting holes 252*b* of the base 252 by virtue of the actuator 272 and fitted into locator holes 264 and 266 of the respective die segments 260. On the opposite lateral sides of the respective pairs of guide rails 254 and 256, there are arranged clamping units 280 for clamping the die segments 260 against removal. Each of the clamping units 280 includes an actuator 282 mounted to the base 252 and a clamp 286 adapted to rotate about a pivot pin 284 by means of the actuator 282 into engagement with the clamp holes 268 of the slider plate 262, thereby clamping the corresponding one of the die segments 260.

In the meantime, the base 212 of the lower die 210 and the base 252 of the upper die 250 are guided by guide posts 290 in a state that the guide posts 290 are slidingly fitted into the guide holes 212*a* and 252*a* of the bases 212 and 252. This ensures that, during the course of descending movement caused by the ram 130, the die segments 260 of the upper die 250 are precisely aligned with the die segments 220 of the lower die 210 to thereby press the workpieces 10 against the die segments 220 of the lower die 210. There is illustrated in FIG. 3 that the press-forming stations 124 (124-1 to 24-n) of the press 100 are provided in six places and further that the die segments 220 of the lower die 210 are respectively arranged in the six press-forming stations 124 (124-1 to 24-n). Moreover, there is illustrated in FIGS. 2 and 4 to 6 that the die segments 220 of the lower die 210 and the die segments 260 of the upper die 250 are respectively four in number. However, the present invention is not limited thereto and it may be possible to increase or decrease the number of the press-forming stations 124 (124-1 to 24-n ), the die segments 220 of the lower die 210 and the die segments 260 of the upper die 250, if the need arises.

Referring to FIGS. 1 and 7 to 13, the present multi-step press system further includes a destacker 300 installed on one side of the press 100 for continuously loading the workpieces 10 one by one. The destacker 300 is designed to stack a large number of, e.g., magnetic blank workpieces 12 one atop another and continuously load the blank workpieces 12 into the standby station 122 of the press 100 one after another.

The destacker 300 includes a destacker frame 310 forming an outer shell thereof and first and second stackers 320*a* and 320*b* provided between the press frame 110 and the destacker frame 310 for receiving and stacking the blank workpieces 12 one atop another. The first and second stackers 320*a* and 320*b* are arranged in a spaced-apart relationship with each other in the Y-axis direction. Each of the first and second stackers 320*a* and 320*b* is provided with a base plate 322 and a plurality of support bars 324 extending upright from the base plate 322 to define a stacking space 326 for reception of the blank workpieces 12. The base plate 322 has an opening 322*a* that communicates on its one side with the stacking space 326.

Figure 7:
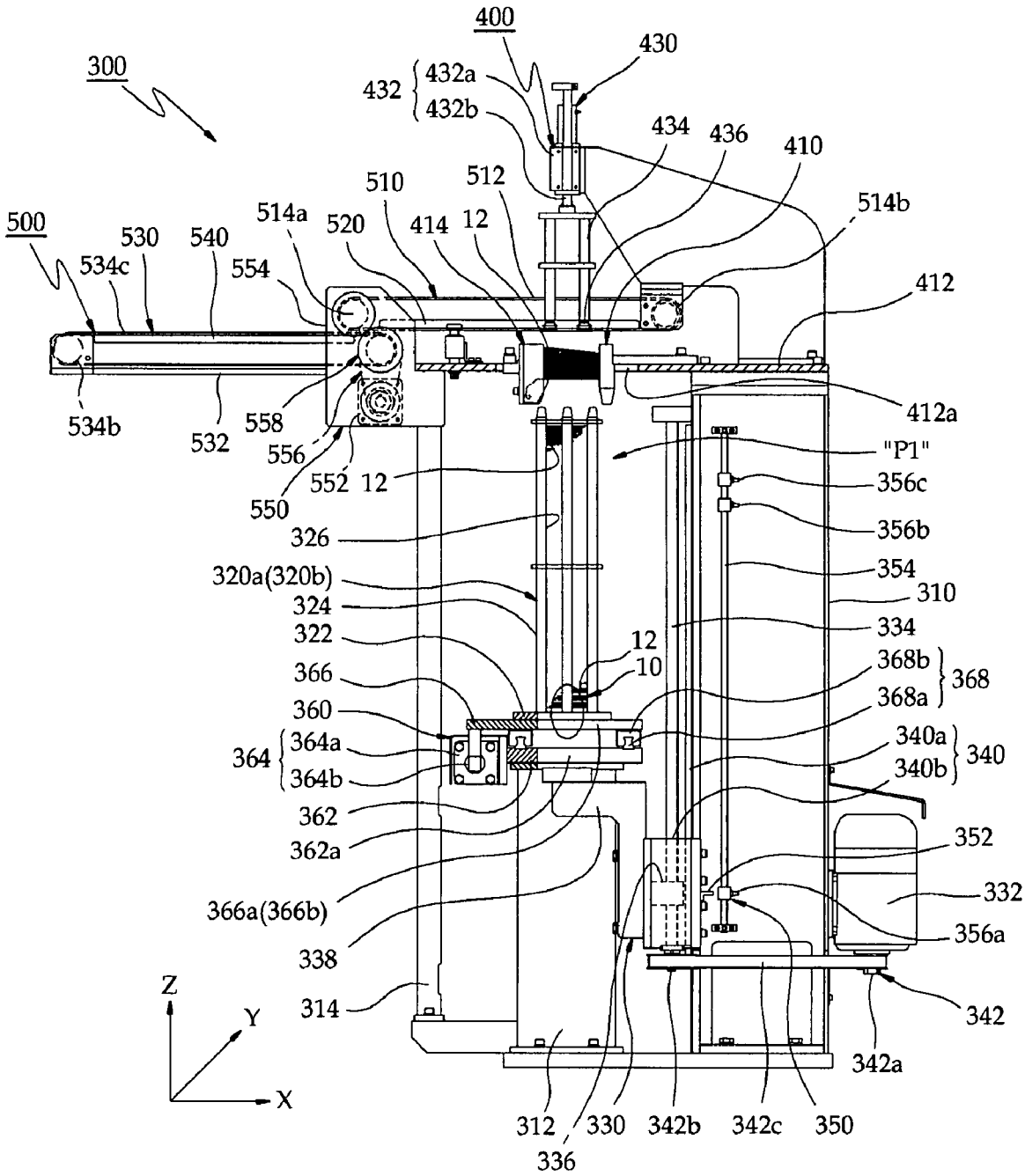
FIG. 7 is a front elevational view illustrating a destacker employed in the present press system.
Figure 9:
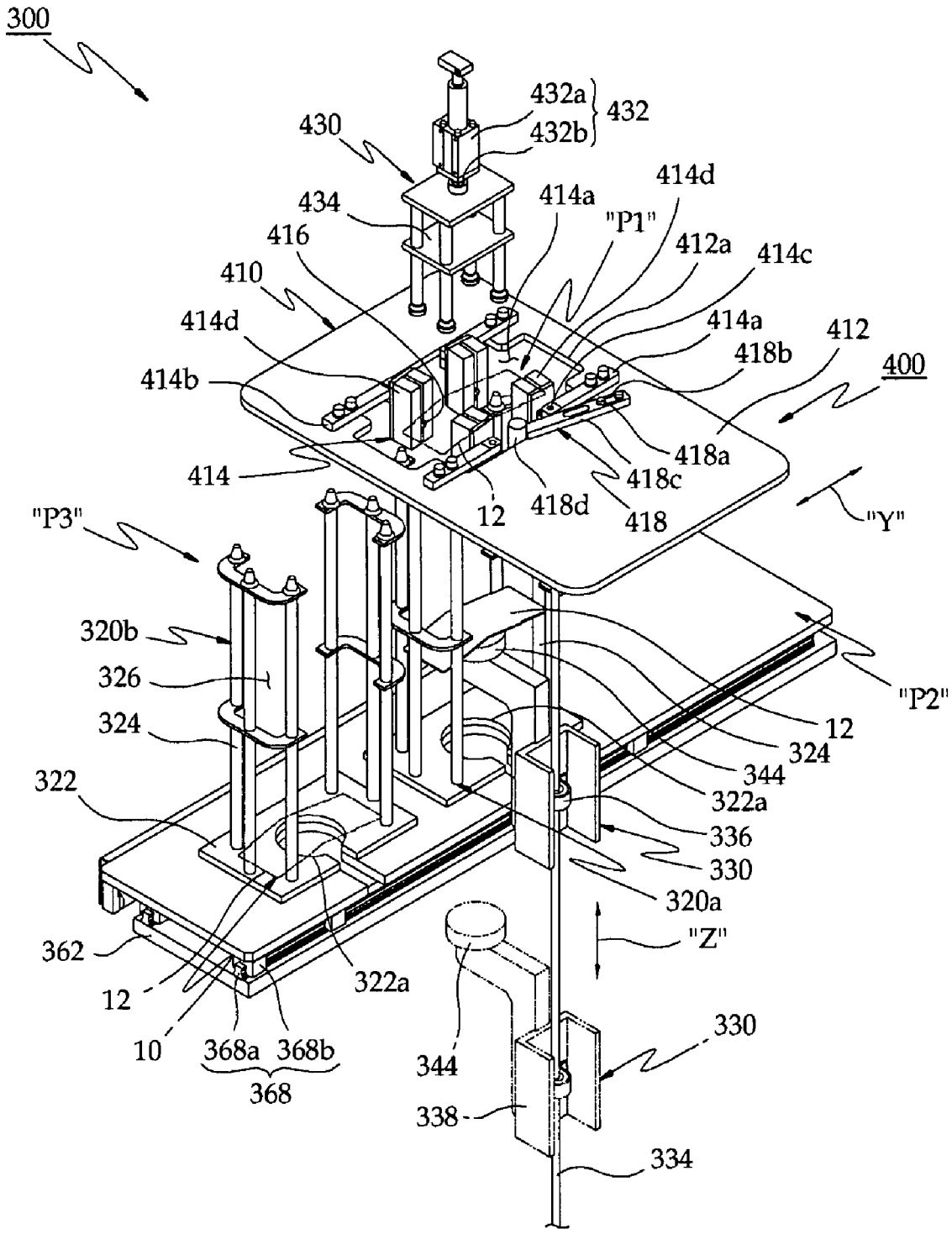
FIG. 9 is a perspective view illustrating the destacker in which a first stacker is in an unloading position and a second stacker is in a second loading position.
Figure 10:
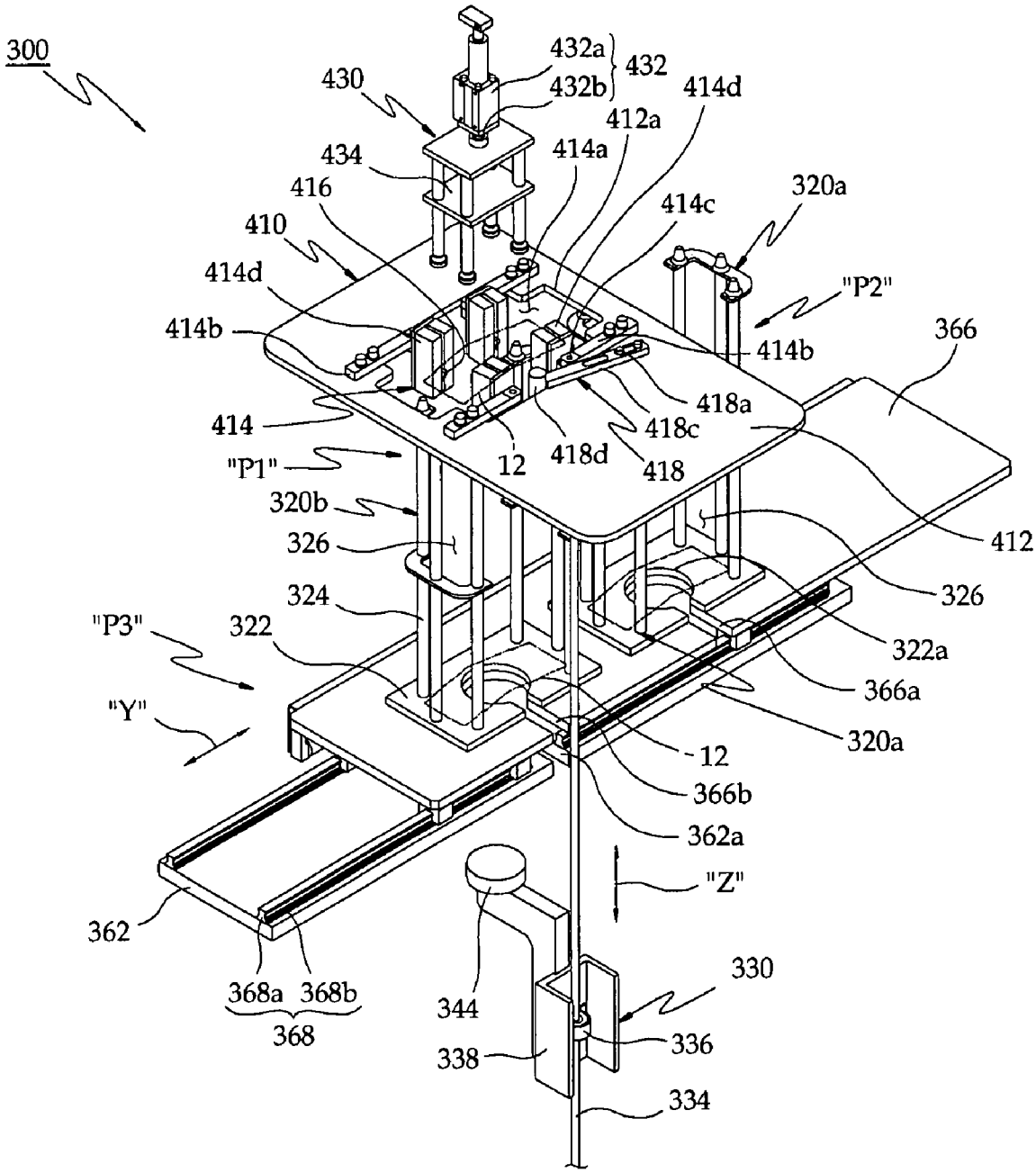
FIG. 10 is a perspective view illustrating the destacker in which the second stacker is in an unloading position and the first stacker is in a first loading position.

As illustrated in FIGS. 7, 9 and 10, the first and second stackers 320*a* and 320*b* are installed in such a manner that they can make rectilinear reciprocating movement in the Y-axis direction of the destacker frame 310 toward and away from an unloading position P1 in which the blank workpieces 12 stacked in the stacking space 326 are handed over to the press 100 one by one. The first and second stackers 320*a* and 320*b* can be alternately placed in the unloading position P1. The first stacker 320*a* is adapted to make rectilinear reciprocating movement between the unloading position P1 and a first loading position P2 in which the blank workpieces 12 are stacked into the stacking space 326 by an operator. Likewise, the second stacker 320*b* is adapted to make rectilinear reciprocating movement between the unloading position P1 and a second loading position P3 in which the blank workpieces 12 are stacked into the stacking space 326 by an operator. As can be seen in FIG. 9, when the first stacker 320*a* lies in the unloading position P1, the second stacker 320*b* is retracted to the second loading position P3. As illustrated in FIG. 10, if the second stacker 320*b* comes into the unloading position P1, the first stacker 320*a* is retracted to the first loading position P2. This makes it possible for the operator to put the blank workpieces 12 into the stacking space 326 of the first stacker 320*a* retracted to the first loading position P2 or the stacking space 326 of the second stacker 320*b* retracted to the second loading position P3.

As can be seen in FIGS. 7 to 10, the blank workpieces 12 received in the stacking spaces 326 of the first and second stackers 320*a* and 320*b* are raised up by means of a lift device 330. The lift device 330 includes a servo motor 332, a lead screw 334, a ball nut 336, a Z-axis carriage 338 and a linear motion guide 340. The servo motor 332 is attached to a lower portion of the destacker frame 310 to generate a drive force. The lead screw 334 extends in a vertical direction on one side of the destacker frame 310 and is operatively connected to the servo motor 332 so that it can be rotated by the drive force of the servo motor 332. The ball nut 336 is threadedly engaged with the lead screw 334 for movement therealong and combined with the Z-axis carriage 338.

The linear motion guide 340 is adapted to guide the rectilinear reciprocating movement of the Z-axis carriage 338. The linear motion guide 340 includes guide rails 340*a* vertically extending on one side of the destacker frame 310 in a mutually parallel relationship, a slider 340*b* slidably coupled to the guide rails 340*a* and fixedly secured to the Z-axis carriage 338. Alternatively, the linear motion guide 340 may be comprised of a pair of guide bars vertically extending on one side of the destacker frame 310 in a mutually parallel relationship and a pair of guide bushes slidably coupled to the guide bars and fixedly secured to the Z-axis carriage 338.

As shown in FIGS. 7, 9 and 10, the drive force of the servo motor 332 is transferred to the lead screw 334 via a belt transmission device 342 that includes a driving pulley 342*a* mounted for rotation with the drive force of the servo motor 332, a driven pulley 342*b* rotatably attached to the bottom end of the lead screw 334 and a belt 342*c* wound around the driving pulley 342*a* and the driven pulley 342*b*. The belt transmission device 342 may be a timing belt transmission device, a gear transmission device or other power transmission devices insofar as they can transfer the drive force of the servo motor 332 to the lead screw 334. The lift device 330 may be substituted by a linear motor guide that has a linear motor mounted within the slider 340*b* of the linear motion guide 340 for causing the Z-axis carriage 338 to move up and down along the guide rails 340*a*. The lift device 330 further includes a pusher 344 attached to the Z-axis carriage 338 in such a fashion that it can push up the blank workpieces 12 received in the stacking space 326 of the first and second stackers 320*a* and 320*b* through the opening 322*a* of the base plate 322.

The position of the Z-axis carriage 338 is sensed by a sensing unit 350 and the operation of the servo motor 332 is controlled by a signal issuing from the sensing unit 350. The sensing unit 350 is comprised of a dog 352, a support bar 354, a bottom dead center sensor 356*a* and a top dead center sensor 356*b*. The sensing dog 352 is fixed to one side of the Z-axis carriage 338, while the support bar 354 is attached to the destacker frame 310 in parallel with the lead screw 334. The bottom dead center sensor 356*a* is attached to a lower portion of the support bar 354 to detect the dog 352 and generate a corresponding signal. The top dead center sensor 356*b* is attached to an upper portion of the support bar 354 to detect the dog 352 and generate a corresponding signal. Furthermore, a preliminary top dead center sensor 356*c* is attached to the upper portion of the support bar 354 at an elevation higher than the top dead center sensor 356*b* to detect the dog 352 and generate a corresponding signal.

Meanwhile, the first stacker 320*a* is adapted to make rectilinear reciprocating movement between the unloading position P1 and the first loading position P2 by means of a Y-axis linear motion actuator 360. In synchronism with the movement of the first stacker 320*a*, the second stacker 320*b* is adapted to make rectilinear reciprocating movement between the unloading position P1 and the second loading position P3 by means of the Y-axis linear motion actuator 360. The Y-axis linear motion actuator 360 is comprised of a base plate 362, an air cylinder 364, a Y-axis carriage 366 and a linear motion guide 368.

The base plate 362 is arranged to extend in the Y-axis direction of the Z-axis carriage 338. The base plate 362 is provided at its opposite ends with apertures 362*a*, each of which is aligned with the opening 322*a* of the base plate 322 of each of the first and second stackers 320*a* and 320*b* so that the pusher 344 of the lift device 330 can move through each of the apertures 362*a*. The base plate 362 is fixed to the support frame 312 of the destacker frame 310. The air cylinder 364 has a cylinder housing 364*a* attached to one side of the base plate 362 and a cylinder rod 364*b* connected at its tip end to the Y-axis carriage 366. Alternatively, the air cylinder 364 may be a rodless cylinder whose cylinder is adapted to move along a cylinder rod.

The Y-axis carriage 366 is adapted to make rectilinear reciprocating movement in the Y-axis direction under the action of the air cylinder 364. The first and second stackers 320*a* and 320*b* are mounted to the Y-axis carriage 366. On the opposite sides of one end of the Y-axis carriage 366, there are formed first and second through-holes 366*a* and 366*b* that can be aligned with the opening 322*a* of each base plate 322 of the first and second stackers 320*a* and 320*b* in the unloading position P1 to thereby allows the pusher 344 of the lift device 330 to pass therethrough.

The Y-axis linear motion guide 368 serves to guide the rectilinear reciprocating movement of the Y-axis carriage 366 in the Y-axis direction. The Y-axis linear motion guide 368 is comprised of a pair of guide rails 368*a* attached to the top surface of the base plate 362 to extend in the Y-axis direction in a parallel relationship with each other and a pair of sliders 368*b* slidably engaged with the guide rails 368*a* and connected to the Y-axis carriage 366. Alternatively, the Y-axis linear motion actuator 360 may be formed of a servo motor, a lead screw, a ball nut and a linear motion guide, just like the lift device 330.

As illustrated in FIGS. 7 and 9 to 13, the destacker 300 further includes an unloader 400 mounted to the top portion of the destacker frame 310 for unloading the workpieces 10, e.g., blank workpieces 12, stacked on one of the first and second stackers 320*a* and 320*b*. The unloader 400 is comprised of a holding device 410, a sensor 420 and a vacuum suction device 430.

The holding device 410 is adapted to receive and hold one of the blank workpieces 12 stacked in one of the first and second stackers 320*a* and 320*b*, e.g., the first stacker 320*a*. At the time when a first topmost blank workpiece 12-1 is picked up by means of the vacuum suction device 430, the holding device 410 serves to separate the first uppermost blank workpiece 12-1 from a second blank workpiece 12-2. The holding device 410 is comprised of a mounting plate 412, a plurality of magnetic clamping units 414, a plurality of stoppers 416 and a supporting unit 418.

Figure 11A:
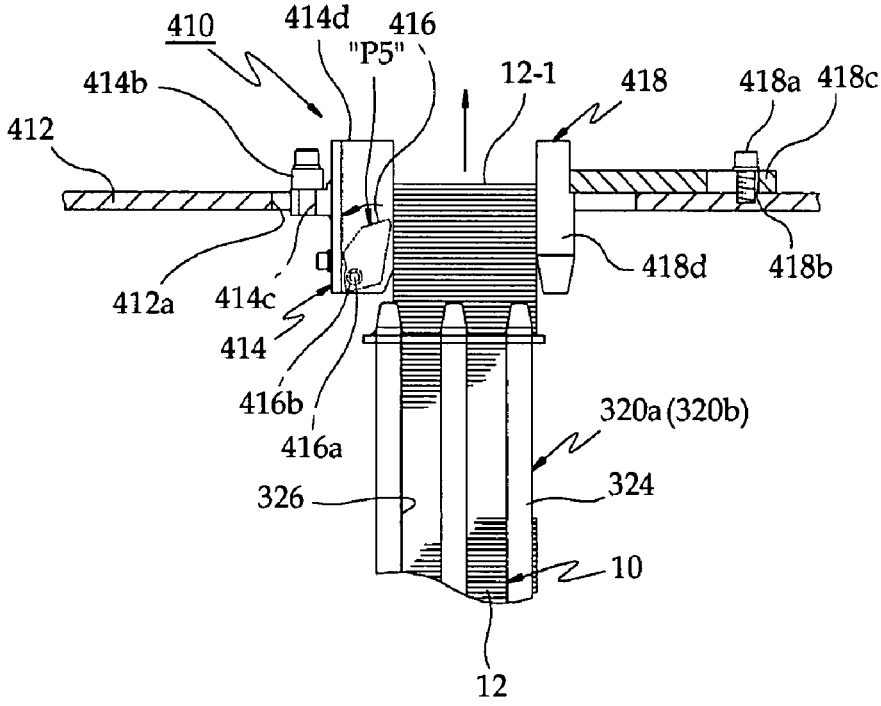
FIGS. 11A and 11B are partially enlarged front views for explaining the operation of transferring workpieces from the first and second stackers of the present destacker to a holding device of an unloader.
Figure 11B:
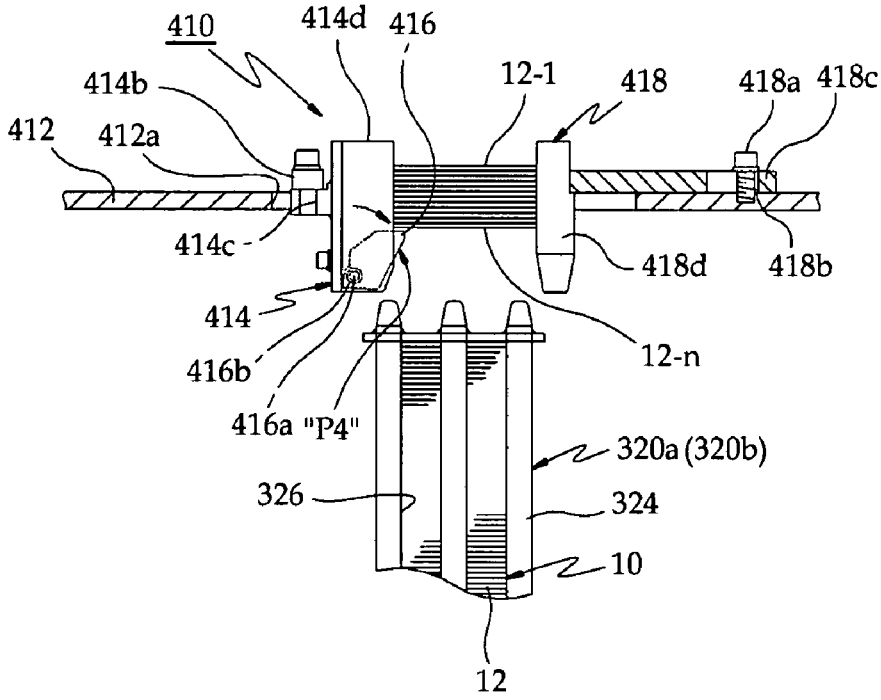

As shown in FIGS. 11A and 11B, the mounting plate 412 is attached to the top portion of the destacker frame 310 and is provided at its one end region with an opening 412*a* that allows the blank workpiece 12 to pass therethrough. The magnetic clamping units 414 are attached to the mounting plate 412 in such a manner as to form a retention space 414*a* for receiving the blank workpieces 12 in plural numbers. The stoppers 416 are attached to the magnetic clamping units 414 for rotation about a pivot 416*a* between a support position P4 in which a lowermost one 12-n of the blank workpieces 12 stacked in the retention space 414*a* is supported by the stoppers 416 and an open position P5 in which the blank workpieces 12 are allowed to move past the stoppers 416. The supporting unit 418 is mounted to the top surface of the mounting plate 412 so that it can support one lateral side of each of the blank workpieces 12 stacked in the retention space 414*a*.

Each of the magnetic clamping units 414 is comprised of a mounting bar 414*b* fixedly secured at its rear end to the top surface of the mounting plate 412 and a magnet 414*d* attached to the tip end of the mounting bar 414*b* for rotation about a pivot 414*c*. The magnet 414*d* may be either a permanent magnet or an electromagnet. The stoppers 416 are attached to a lower portion of the magnet 414*d* for rotation about a pivot 416*a* on which a torsion spring 416*b* is retained to resiliently biasing the stoppers 416 from the open position P5 toward the support position P4. The stoppers 416 can be rotated by means of an actuator, if necessary.

The supporting unit 418 is comprised of a mounting bar 418*c* having a slot 418*b* through which a screw 418*a* is tightened to the top surface of the mounting plate 412 for adjustment of the position of the supporting unit 418 and a setting pin 418*d* fixed to the tip end of the mounting bar 418*c* in such a manner as to support one lateral side of each of the blank workpieces 12. Depending on the size of the blank workpieces 12, an operator can adjust the rotational position of the magnet 414*d* and the fixing position of the mounting bar 418*c* to ensure that the blank workpieces 12 are stably stacked into the retention space 414*a*.

Figure 12:
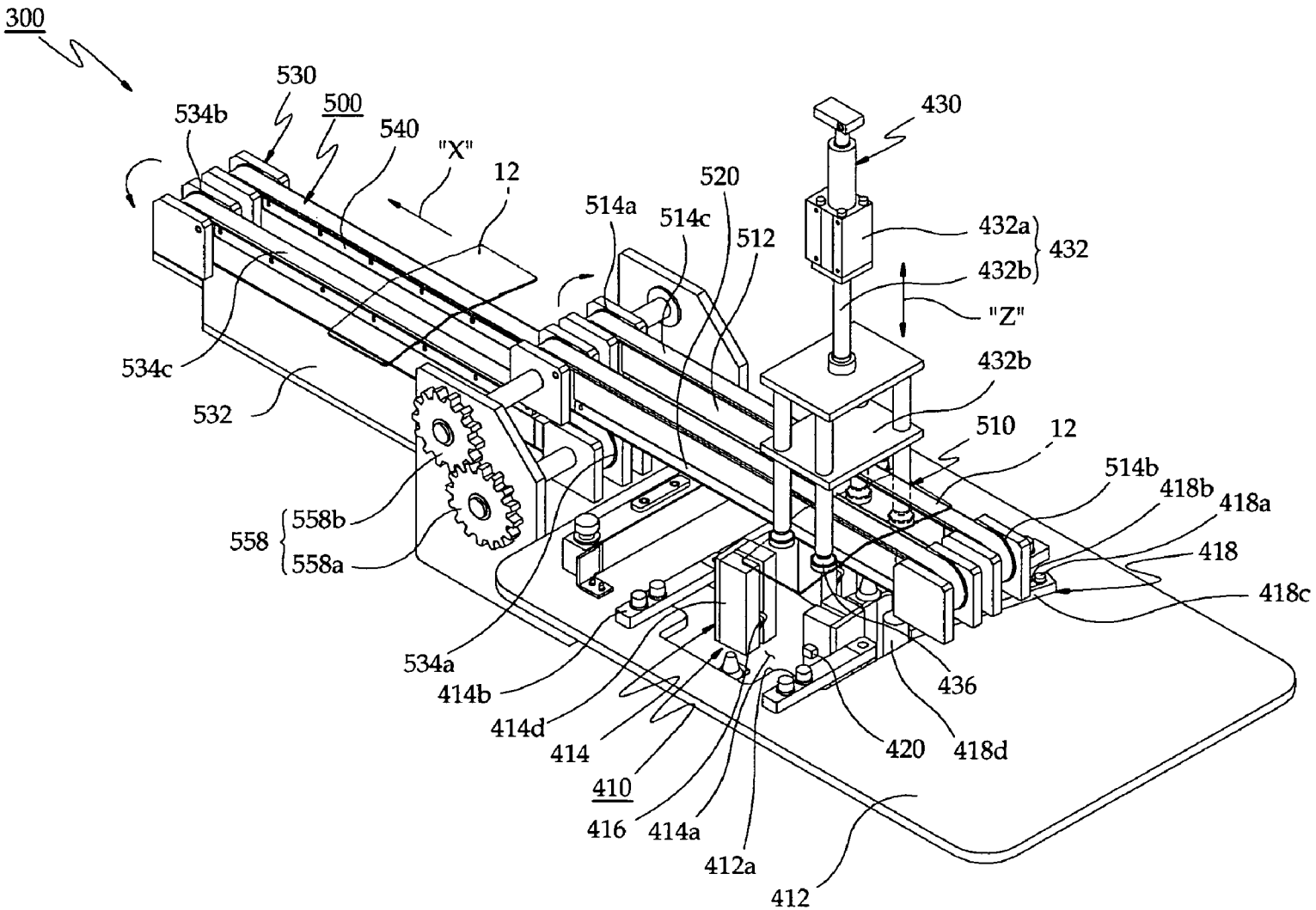
FIG. 12 is a perspective view illustrating an unloader, a vacuum suction device and a loading feeder employed in the present destacker.
Figure 13:
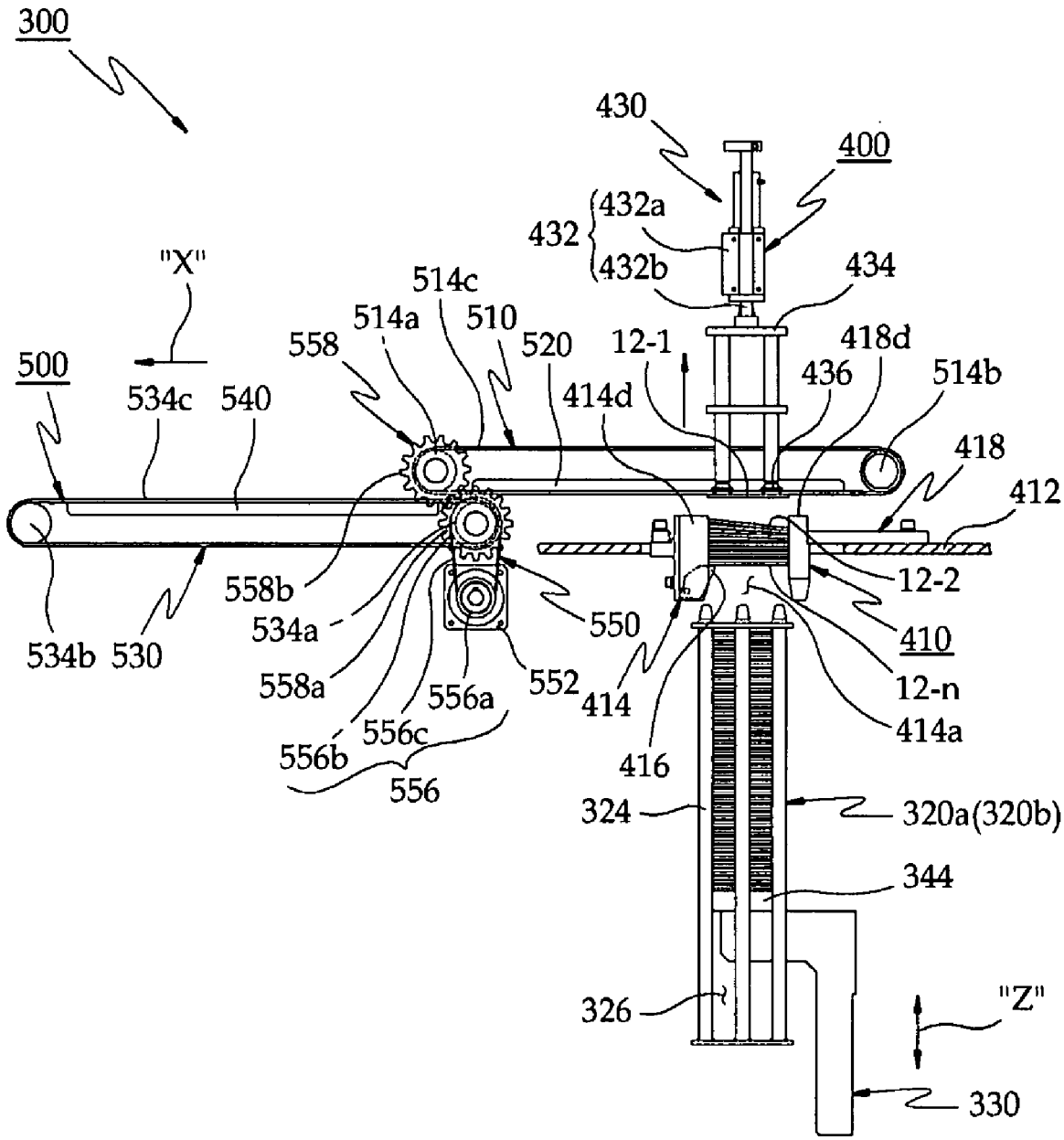
FIG. 13 is a front elevational view for explaining the operation of the unloader, the vacuum suction device and the loading feeder employed in the present destacker.

As illustrated in FIG. 13, as the first blank workpiece 12-1 is picked up by the vacuum suction operation of the vacuum suction device 430, the second blank workpiece 12-2 stacked in the retention space 414*a* of the holding device 410 is separated from the first blank workpiece 12-1 under the action of a magnetic force of the magnet 414*d*. This helps to prevent a possibility that two blank workpieces 12 are simultaneously unloaded by the vacuum suction device 430. As shown in FIG. 12, a sensor 420 is arranged on one side of the holding device 410 so that it can detect the blank workpieces 12 stacked in the retention space 414*a* of the holding device 410 and generate a corresponding signal. If it is determined with the aid of the sensor 420 that no blank exists in the retention space 414*a* of the holding device 410, the servo motor 332 of the lift device 330 is operated to raise up the first stacker 320*a* or the second stacker 320*b*, thereby loading a required number of blank workpieces 12 into the holding device 410.

Referring to FIGS. 7, 9, 10, 12 and 13, the vacuum suction device 430 is comprised of an air cylinder 432, a joint plate 434 and a plurality of vacuum pads 436. The air cylinder 432 has a cylinder housing 432*a* attached to the top portion of the destacker frame 310 in such a manner as to lie above the holding device 410 and a cylinder rod 432*b* fitted into the cylinder housing 432*a* for extension and retraction in the Z-axis direction. The joint plate 434 is secured to the tip end of the cylinder rod 432*b*. The vacuum pads 436 are attached to the bottom end of the joint plate 434 so that they can suck up the first blank workpiece 12-1 with a vacuum pressure. The vacuum pads 436 are connected to a well-known air suction device (not shown) such as a vacuum pump or an air compressor via an air line.

If the cylinder rod 432*b* is extended by the operation of the air cylinder 432, the vacuum pads 436 are lowered down to make close contact with the first blank workpiece 12-1, one of the blank workpieces 12 stacked in the retention space 414*a* of the holding device 410. The first blank workpiece 12-1 is stuck to the vacuum pads 436 if the air suction device is operated to generate a vacuum pressure in the state that the vacuum pads 436 are brought into contact with the first blank workpiece 12-1. Subsequently, if the cylinder rod 432*b* is retracted by the operation of the air cylinder 432, the vacuum pads 436 are raised up together with the first blank workpiece 12-1 to thereby unload the first blank workpiece 12-1 from the retention space 414*a* of the holding device 410.

Referring to FIGS. 1, 7, 12 and 13, the destacker 300 of one embodiment of the present invention further includes a loading feeder 500 that receives the blank workpieces 12 from the holding device 410 of the unloader 400 and then loads them into the standby station 122 of the press 100. The loading feeder 500 is comprised of a first belt conveyor 510, a first magnetic bar 520, a second belt conveyor 530, a second magnetic bar 540 and a drive device 550 for operating the first belt conveyor 510 and the second belt conveyor 530. The first belt conveyor 510 has a front end portion overlapped with a rear end portion of the second belt conveyor 530. The second belt conveyor 530 is arranged below the first belt conveyor 510.

As shown in FIGS. 7, 12 and 13, the first belt conveyor 510 includes a first conveyor frame 512 provided above the destacker frame 310 to extend in the X-axis direction between the holding device 410 of the unloader 400 and the vacuum suction device 430, a first driving pulley 514*a* rotatably mounted to the front end of the first conveyor frame 512, a first driven pulley 514*b* rotatably mounted to the rear end of the first conveyor frame 512, and a first belt 514*c* wound around the first driving pulley 514*a* and the first driven pulley 514*b*. The second belt conveyor 530 includes a second conveyor frame 532 provided above the destacker frame 310 to extend in the frontward direction, a second driving pulley 534*a* rotatably mounted to the rear end of the second conveyor frame 532, a second driven pulley 534*b* rotatably mounted to the front end of the second conveyor frame 532, and a second belt 534*c* wound around the second driving pulley 534*a* and the second driven pulley 534*b*.

The first magnetic bar 520 is mounted in parallel with and arranged inside the first belt 514*c* of the first belt conveyor 510. This means that, when the blank workpiece 12 is sucked and raised up from the holding device 410 by means of the vacuum pads 436 of the vacuum suction device 430, it is stuck to the underside of the first belt 514*c* under the action of a magnetic attracting force of the first magnetic bar 520. The blank workpiece 12 stuck to the underside of the first belt 514*c* is fed in the X-axis direction as the first belt 514*c* runs. The second magnetic bar 540 is mounted in parallel with and arranged inside the second belt 534*c* of the second belt conveyor 530. This means that, when the blank workpiece 12 is separated from the first belt 514*c* of the first belt conveyor 510, it is stuck to the top surface of the second belt 534*c* under the action of a magnetic attracting force of the second magnetic bar 540. The blank workpiece 12 stuck to the top surface of the second belt 534*c* is fed in the X-axis direction as the second belt 534*c* runs. There is illustrated in FIG. 12 that each of the first and second belt conveyors 510 and 530 consists of a dual-row belt conveyor in which each of the first and second belts 514*c* and 534*c* is arranged in two rows. Also illustrated in FIG. 12 is that each of the first and second magnetic bars 520 and 540 is arranged in a corresponding relationship with the two rows of the first and second belts 514*c* and 534*c*. However, this is merely for the purpose of illustration and, therefore, the number of the first and second belts 514*c* and 534*c* and the first and second magnetic bars 520 and 540 may be suitably changed depending on the loading requirements of the blank workpieces 12.

The drive device 550 is provided with an electric motor 552 that generates a drive force for use in simultaneously rotating the first driving pulley 514*a* of the first belt conveyor 510 and the second driving pulley 534*a* of the second belt conveyor 530. The motor 552 is attached to a mounting plate 554 fixedly secured to the first conveyor frame 512 of the first belt conveyor 510 and the second conveyor frame 532 of the second belt conveyor 530. The mounting plate 554 is supported on the post 314 of the destacker frame 310. The drive force of the motor 552 is transferred to the first driving pulley 514*a* of the first belt conveyor 510 through a belt transmission device 556. The belt transmission device 556 is comprised of a driving pulley 556*a* mounted for rotation by the drive force of the motor 552, a driven pulley 556*b* mounted coaxially with the first driving pulley 514*a* of the first belt conveyor 510 so that it can rotate together with the first driving pulley 514*a*, and a belt 556*c* wound around the driving pulley 556*a* and the driven pulley 556*b*. The drive force of the motor 552 is transferred to the second driving pulley 534*a* of the second belt conveyor 530 through a gear device 558. The gear device 558 includes a driving gear 558*a* mounted coaxially with the driving pulley 556*a* of the belt transmission device 556 for unitary rotation therewith by the drive force of the motor 558 and a driven gear 558*b* meshing with the driving gear 558*a*, the driven gear 558*b* being mounted coaxially with the second driving pulley 534*a* of the second belt conveyor 530 for unitary rotation therewith. A stand 560 is arranged in the standby station 122 adjacent to the front end of the second conveyor belt 530. The stand 560 is adapted to receive the blank workpiece 12 conveyed by the second belt conveyor 530.

Figure 14:
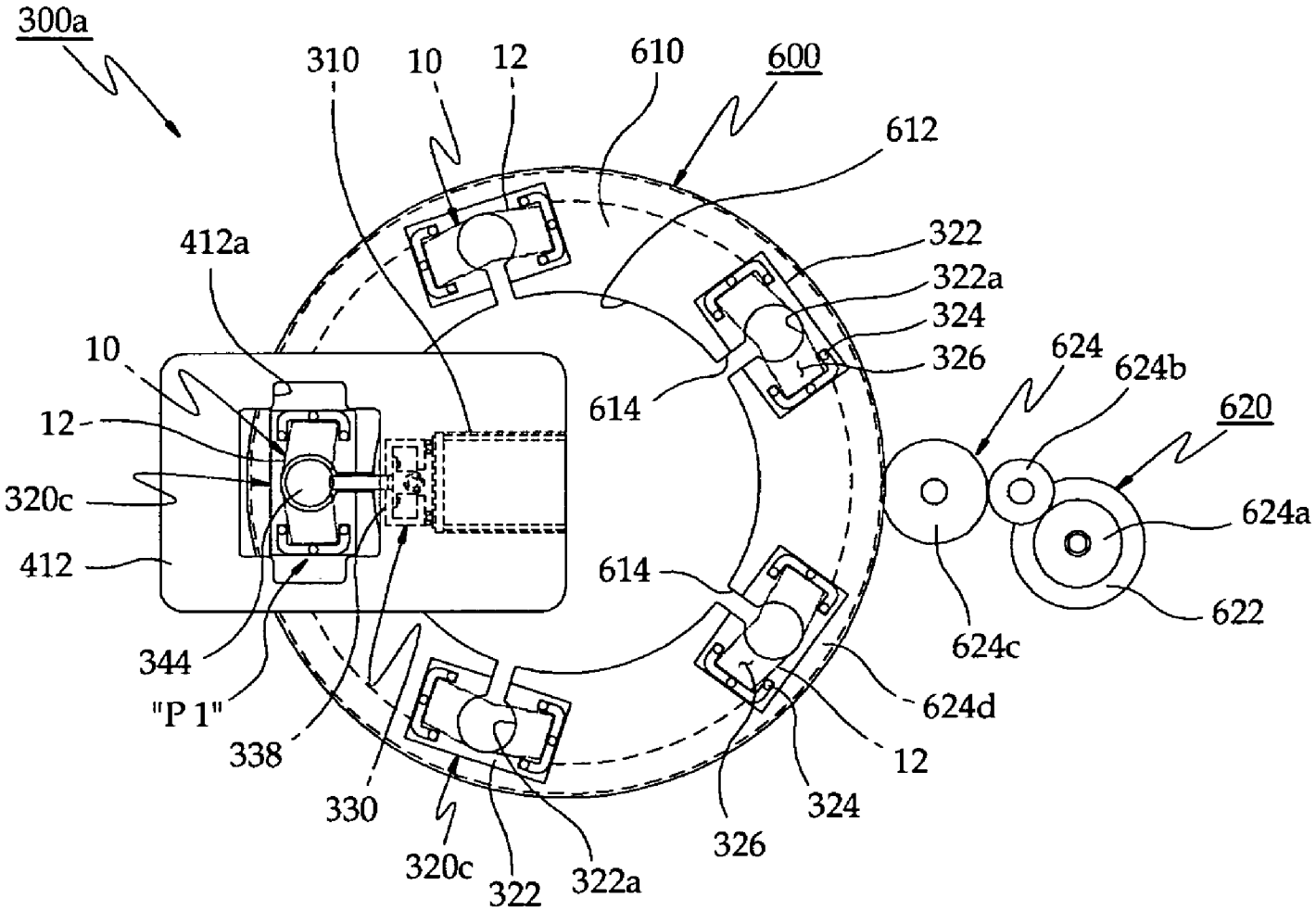
FIG. 14 is a top view showing another embodiment of the destacker in accordance with one embodiment of the present invention.

Another example of the destacker of one embodiment of the present invention is illustrated in FIG. 14. In describing a destacker 300*a* of this example, the same parts or components as those of the destacker 300 set forth above will be designated by like reference numerals. In a lower portion of the destacker 300*a*, there is provided an indexing device 600 for making angular movement to sequentially bring a plurality of stackers 320*c* into an unloading position P1 of the destacker 300*a*, which task is performed by the Y-axis linear motion actuator 360 in the preceding example. The indexing device 600 includes an indexing table 610 and a table driver 620 for inducing angular movement of the indexing table 610.

As with the first and second stackers 320*a* and 320*b* described above, each of the stackers 320*c* has a base plate 322 and a plurality of support bars 324, both of which cooperate to define a stacking space 326 for receiving and stacking the blank workpieces 12. At the center of the indexing table 610, there is formed a center opening 612 in which the destacker frame 310 lies. Formed along an inner circumferential surface of the indexing table 610 are a plural number of radial through-holes 614 each aligned with an opening 322*a* of the base plate 322 of the respective stackers 320*c*. There is illustrated in FIG. 14 that five stackers 320*c* are arranged on the indexing table 610 at equal intervals in a circumferential direction. However, the present invention is not limited thereto and the number of the stackers 320*c* may be greater or lesser.

The table driver 620 includes an electric indexing motor 622 attached to one side of the destacker frame 310 for generating a drive force and a gear device 624 for transferring the drive force of the indexing motor 622 to the indexing table 610. The gear device 624 is comprised of a driving gear 624*a* mounted for rotation by the drive force of the indexing motor 622, intermediate gears 624*b* and 624*c* remaining in a meshing engagement with each other to transfer the rotational force of the driving gear 624*a*, and a driven ring gear 624*d* attached to the underside of the indexing table 610 in a meshing engagement with the intermediate gear 624*c*.

Referring back to FIGS. 1 through 3, the present multi-step press system further includes a transfer feeder 700 for simultaneously transferring the blank workpieces 12 placed on the press-forming stations 124 of the press 100 and the stand 560. The transfer feeder 700 is provided between the table 120 of the press 100 and the ram 130 in such a manner that it can be moved both in the X-axis direction, i.e., the loading direction of the blank workpieces 12, and in the Z-axis direction. The transfer feeder 700 includes a plurality of vacuum suction units 710 for simultaneously sucking up the blank workpieces 12 placed on the press-forming stations 124 of the press 100 and the stand 560 and a robot unit 720 for causing the vacuum suction units 710 to move in the X-axis and Z-axis directions of the press 100.

Each of the vacuum suction units 710 includes an arm 712 mounted for movement in the X-axis direction of the press 100 and a vacuum pad 714 attached to the tip end of the arm 712 for vacuum suction of the respective blank workpieces 12 placed on the press-forming stations 124 of the press 100 and the stand 560. The vacuum pads 714 of the vacuum suction units 710 are connected to a well-known air suction device (not shown) such as a vacuum pump or an air compressor via an air line.

The robot unit 720 includes an X-axis linear motion actuator 722 for causing the arm 712 to move in the X-axis direction of the press 100 and a Z-axis linear motion actuator 724 for causing the X-axis linear motion actuator 722 to move in the Z-axis direction of the press 100. Each of the X-axis linear motion actuator 722 and the Z-axis linear motion actuator 724 may be comprised of a servo motor for generating a drive force, a lead screw adapted to rotate by the drive force of the servo motor, a ball nut threadedly engaged with the lead screw and attached to a carriage, and a linear motion guide for guiding the rectilinear reciprocating movement of the carriage. Moreover, each of the X-axis linear motion actuator 722 and the Z-axis linear motion actuator 724 may be either comprised of an air cylinder, a carriage and a linear motion guide or comprised of a servo motor, a rack-and-pinion, a carriage and a linear motion guide.

Referring again to FIGS. 1 and 2, the present multi-step press system further includes a numerically controlled leveler feeder 800 provided on the other side of the press 100 for loading a coil workpiece 14 in the form of a roll, another example of the afore-mentioned workpiece 12. The leveler feeder 800 includes an uncoiler 820 for unwinding the coil workpiece 14 held by a supply reel 810 through the operation of a pusher 822 and a leveler 830 for straightening the coil workpiece 14 supplied from the uncoiler 820 and then loading the same into the last downstreammost press-forming station 124-n among the press-forming stations 124 of the press 100. In this regard, the last press-forming station 124-n of the press 100 serves as a station wherein the coil workpiece 14 loaded by the leveler feeder 800 is blanked into the blank workpiece 12, i.e., a primary processing station.

The press 100, the destacker 300, the transfer feeder 700 and the leveler feeder 800 of the present multi-step press system are operated under the sequence control of a control board 900. The control board 900 may be a computer capable of sequence-controlling the press 100, the destacker 300, the transfer feeder 700 and the leveler feeder 800 of the present multi-step press system.

From now, description will be made on the operation of the present multi-step press system constructed as above.

First of all, steps of processing the blank workpiece 12, one example of the workpiece 10, into a desired product will be described with reference to FIGS. 1 through 6. The lower die 210 and the upper die 250 of the press die set 200 are respectively attached to the table 120 and the ram 130 of the press 100. Each of the die segments 220 of the lower die 210 is fixed in place by slidingly inserting the slider plate 222 thereof into between the grooves 214*a* and 216*a* of each pair of guide rails 214 and 216.

The actuator 232 of each of the locators 230 is operated to extend the locator pins 234 and 236 into engagement with the locator holes 224 and 226 of the slider plate 222, thereby aligning the position of the respective die segments 220. Then, the actuator 242 of each of the clamping units 240 is operated to rotate the clamps 246 about the pivots 244, whereby the clamps 246 are fitted into the clamping holes 228 of the slider plate 222 to releasably clamp the corresponding die segment 220.

Just like the manner of fitting the die segments 220 of the lower die 210 as noted above, the segment dies 260 of the upper die 250 are fixed to the ram 130 of the press 100 by slidingly inserting the segment dies 260 into between the guide rails 254 and 256, having the second locators 270 align the position of the segment dies 260 and allowing the clamping units 240 to clamp the segment dies 260 against removal.

Use of the afore-mentioned arrangement by which the die segments 220 of the lower die 210 and the die segments 260 of the upper die 250 are fixed in place in a cartridge-like manner makes it possible for the operator to attach and remove the press die set 200 with ease. Furthermore, in case the die segments 220 and 260 are damaged in part, the damaged die segment alone can be replaced with a new one. This helps to shorten the time required in changing the press die set, thus enhancing the ease of work and the interchangeability of components. Moreover, the die segments 220 and 260 become structurally simple, thereby shortening the time period required in developing and designing the press die set and eventually reducing production costs.

Figure 8:
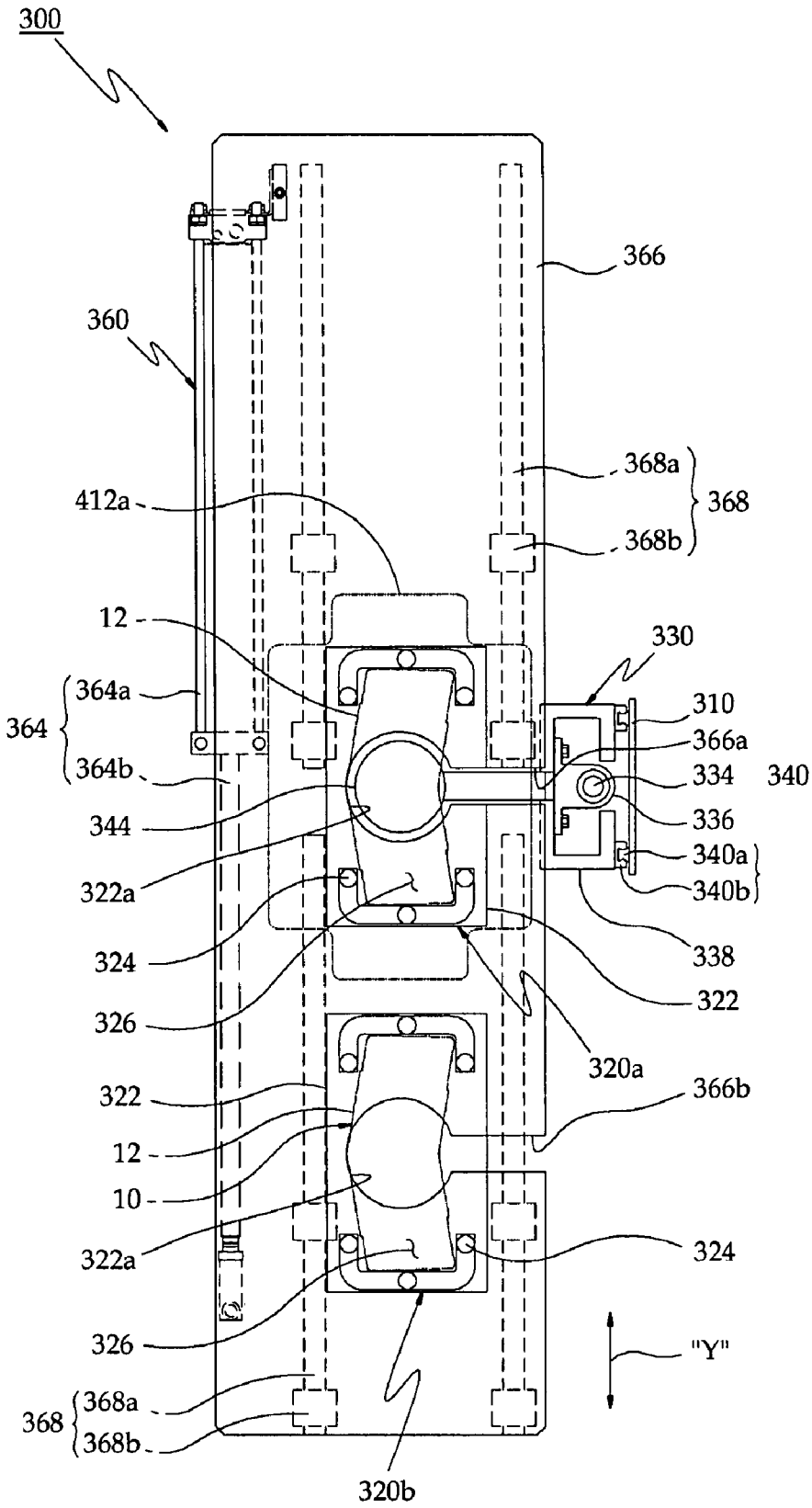
FIG. 8 is a top view showing a lift device and a Y-axis linear motion actuator of the destacker employed in the present press system.

Referring to FIGS. 7, 8 and 9, a large number of blank workpieces 12 once press-formed at an earlier stage are stacked in the stacking space 326 of the first and second stackers 320*a* and 320*b*. Then, the Y-axis linear motion actuator 360 is operated to bring one of the first and second stackers 320*a* and 320*b*, e.g., the first stacker 320*a*, into the unloading position P1.

Subsequently, if the servo motor 332 of the lift device 330 begins to rotate clockwise in the state that the first stacker 320*a* is placed in the unloading position P1, the lead screw 334 is rotated by the drive force of the servo motor 332, in response to which the ball nut 336 threadedly moves along the lead screw 334 in an upward direction to thereby raise up the Z-axis carriage 338 and the pusher 344 as a unit. At this time, the linear motion guide 340 ensures that the upward movement of the Z-axis carriage 338 becomes rectilinear. During its upward movement, the pusher 344 passes the apertures 362*a* of the base plate 362, the first through-hole 366*a* of the Y-axis carriage 366 and the opening 322*a* of the base plate 322 in the named sequence, eventually pushing up the blank workpieces 12 accommodated within the stacking space 326 of the first stacker 320*a*.

As illustrated in FIG. 11A, when the blank workpieces 12 accommodated within the stacking space 326 of the first stacker 320*a* are pushed up by virtue of the pusher 344, the first uppermost blank workpiece 12-1 pushes the stoppers 416 of the holding device 410 in the upward direction. Thus, the stoppers 416 are rotated about the pivot 416*a* from the support position P4 into the open position P5, allowing the first stacker 320*a* to move upwards. Referring to FIG. 7, the servo motor 332 is stopped if the dog 352 of the Z-axis carriage 338 is detected by the top dead center sensor 356*b*. The stoppers 416 are then returned from the open position P5 back to the support position P4 under the biasing force of the torsion spring 416*b*, at which time the tip ends of the stoppers 416 are interposed between two blank workpieces 12. If the servo motor 332 of the lift device 330 turns counterclockwise, the Z-axis carriage 338 and the pusher 344 are lowered down by the drive force of the servo motor 332 through an operation opposite to the operation noted just above. The servo motor 332 is stopped if the dog 352 of the Z-axis carriage 338 is detected by the bottom dead center sensor 356*a*. Referring to FIG. 11B, as the pusher 344 descends, the blank workpieces 12 entered into the retention space 414*a* of the holding device 410 are supported by the stoppers 416.

As shown in FIGS. 12 and 13, if the sensor 420 detects the blank workpieces 12 kept in the retention space 414*a* of the holding device 410, the air cylinder 432 of the vacuum suction device 430 is operated to extend the cylinder rod 432*b*, in response to which the vacuum pads 436 are lowered down to suck up the first blank workpiece 12-1 held in the retention space 414*a*. Thereafter, the cylinder rod 432*b* is retracted by the operation of the air cylinder 432 to lift up the vacuum pads 436 and the first blank workpiece 12-1. At the time when the first blank workpiece 12-1 is lifted up by the vacuum pads 436 of the vacuum suction device 430, the second blank workpiece 12-2 held in the retention space 414*a* of the holding device 410 is separated from the first blank workpiece 12-1 by the magnetic force of the magnet 414*b*. This prevents occurrence of an erroneous operation that the first blank workpiece 12-1 and the second blank workpiece 12-2 would be stuck to each other and simultaneously unloaded.

Subsequently, the first blank workpiece 12-1 vacuum-sucked and lifted up by the vacuum pads 436 of the vacuum suction device 430 is stuck to the first belt 514*c* of the first belt conveyor 510 by the magnetic force of the first magnetic bar 520, at which time the air cylinder 432 stops its operation. Then, the motor 552 of the drive device 550 is energized to generate a drive force which in turn is transferred to the first driving pulley 514*a* of the first belt conveyor 510 via the driving pulley 556*a*, the driven pulley 556*b* and the belt 556*c* of the belt transmission device 556. As the first driving pulley 514*a* rotates, the first belt 514*c* wound around the first driving pulley 514*a* and the first driven pulley 514*b* runs to thereby load the first blank workpiece 12-1 in the X-axis direction.

Furthermore, the drive force of the motor 552 is transferred to the second driving pulley 534*a* of the second belt conveyor 530 via the driving gear 558*a* and the driven gear 558*b* of the gear device 558. As the second driving pulley 534*a* rotates, the second belt 534*c* wound around the second driving pulley 534*a* and the second driven pulley 534*b* begins to run. The first blank workpiece 12-1 stuck to the underside of the first belt 514*c* is separated from the first belt 514*c* at the front end of the first belt conveyor 510 and then transferred to the second belt conveyor 530 where the first blank workpiece 12-1 is stuck to the second belt 534*c* by the magnetic force of the second magnet 540. The second belt 534*c* conveys the first blank workpiece 12-1 in the X-axis direction. The first blank workpiece 12-1 thus conveyed is separated from the front end of the second belt conveyor 530 and laid down on the stand 560 of the standby station 122.

Through the same loading operation as applied to the first blank workpiece 12-1, the blank workpieces 12 held in the retention space 414*a* of the holding device 410 are loaded one by one onto the stand 560 of the standby station 122 until the retention space 414*a* becomes empty. If no blank workpiece is detected by the sensor 420, the control board 900 performs sequence control to operate the lift device 330 so that a required number of new blank workpieces 12 can be loaded into the retention space 414*a* of the holding device 410 by means of the lift device 330.

Referring to FIGS. 9 and 10, after the blank workpieces 12 stacked in the stacking space 326 of the first stacker 320*a* have been loaded into the standby station 122 of the press 100 in their entirety, the air cylinder 364 of the Y-axis linear motion actuator 360 is operated to extend the cylinder rod 364*b*, in response to which the Y-axis carriage 366 makes rectilinear movement along the linear motion guide 368 in the Y-axis direction. By virtue of the rectilinear movement of the Y-axis carriage 366, the first stacker 320*a* is displaced from the unloading position P1 to the first loading position P2 and the second stacker 320*b* is moved from the second loading position P3 to the unloading position P1. In the first loading position P2, the blank workpieces 12 are newly stacked into the empty stacking space 326 of the first stacker 320*a*. In the unloading position P1, the blank workpieces 12 stacked in the stacking space 326 of the second stacker 320*b* are loaded into the standby station 122 of the press 100 through the same loading operation as applied to the first blank workpiece 12-1. In this way, the blank workpieces 12 can be alternately loaded by use of the first and second stackers 320*a* and 320*b*. This helps to minimize the time wasted in loading the blank workpieces 12, which leads to increased productivity and reduced production costs.

As shown in FIG. 14, the table driver 620 of the indexing device 600 is operated to induce angular movement of the indexing table 610, thereby bringing one of the stackers 320*c* into alignment with the unloading position P1 of the destacker 300*a*. In the unloading position P1, the stacker 320*c* is moved in the Z-axis direction by the lift device 330 to load a required number of blank workpieces 12 into the retention space 414*a* of the holding device 410. This loading method by which the blank workpieces 12 are loaded using the plurality of stackers 320*c* arranged on the indexing table 610 of the indexing device 600 can reduce the time spent in loading the blank workpieces 12 and the number of operators engaged in operating the destacker 300*a*, as compared to the afore-mentioned loading method by which the blank workpieces 12 are alternately loaded using the first and second stackers 320*a* and 320*b* operated by the Y-axis linear motion actuator 360.

Referring again to FIGS. 1 through 3, if the first blank workpiece 12-1 is laid down on the stand 560 of the standby station 122, the X-axis linear motion actuator 722 of the robot unit 720 is operated to displace the arms 712 of the vacuum suction units 710 in the X-axis direction so that the first upstreammost vacuum pad 714-1 among the vacuum pads 714 can be placed above the stand 560. Then, the X-axis linear motion actuator 722 is stopped and the Z-axis linear motion actuator 724 is operated to lower down the arms 712. The first vacuum pad 714-1 descending together with the arms 712 sucks up the first blank workpiece 12-1 placed on the stand 560.

Once the first blank workpiece 12-1 is sucked up by the first vacuum pad 714-1 of the vacuum suction units 710, the arms 712 are raised up by the Z-axis linear motion actuator 724, after which Z-axis linear motion actuator 724 stops its operation. Then, the X-axis linear motion actuator 722 is operated again to displace the first vacuum pad 714-1 in the X-axis direction so that the first vacuum pad 714-1 can be placed above and aligned with the first press-forming station 124-1, after which X-axis linear motion actuator 722 stops its operation.

Next, the Z-axis linear motion actuator 724 is operated again to lower down the arms 712 and is stopped when the first vacuum pad 714-1 descending together with the arms 712 comes closer to the die segment 220 of the lower die 210 placed in the first press-forming station 124-1. If the vacuum suction force of the first vacuum pad 714-1 is removed in the state that the first vacuum pad 714-1 lies adjacent to the die segment 220 of the lower die 210 placed in the first press-forming station 124-1, the first blank workpiece 12-1 sucked up by the first vacuum pad 714-1 is laid down on the die segment 220. After the first blank workpiece 12-1 has been loaded in this manner, the X-axis linear motion actuator 722 and the Z-axis linear motion actuator 724 are operated to return the vacuum pads 714 to their initial positions in between the respective die segments 220.

Under the state that the first blank workpiece 12-1 is loaded onto the die segment 220 of the lower die 210 placed in the first press-forming station 124-1, the ram 130 is operated such that the ram 130 and the die segments 220 of the upper die 250 can move downwards to thereby press-form the first blank workpiece 12-1. During the time when the first blank workpiece 12-1 is press-formed by the operation of the ram 130, the destacker 300 is operated to load the second blank workpiece 12-2 onto the stand 560.

If the ram 130 moves upwards into its initial position after the first blank workpiece 12-1 has been press-formed, the X-axis linear motion actuator 722 and the Z-axis linear motion actuator 724 of the robot unit 720 are operated to bring the vacuum pads 714 of the vacuum suction units 710 into contact with the first blank workpiece 12-1 placed in the first press-forming station 124-1 and the second blank workpiece 12-2 laid on the stand 560. If the first blank workpiece 12-1 and the second blank workpiece 12-2 are sucked up by the vacuum pads 714 of the vacuum suction units 710, the X-axis linear motion actuator 722 and the Z-axis linear motion actuator 724 of the robot unit 720 are operated again to load the first blank workpiece 12-1 onto the die segment 220 of the lower die 210 placed in the second press-forming station 124-2, while loading the second blank workpiece 12-2 onto the die segment 220 of the lower die 210 placed in the first press-forming station 124-1. If the vacuum suction units 710 are operated to remove the vacuum suction forces of the vacuum pads 714, the first blank workpiece 12-1 and the second blank workpiece 12-2 are laid down on the corresponding die segments 220.

The first blank workpiece 12-1 is sequentially transferred from one press-forming station to another by the transfer feeder 700 and press-formed step by step in the respective press-forming stations 124 by means of the die segments 220 of the lower die 210 and the die segments 260 of the upper die 250, eventually becoming a final product in the last press-forming station 124-n. The final product that has undergone the press-forming process is unloaded from the last press-forming station 124-n either manually or through the use of an unloader or an ejector well-known in the art.

As set forth above, the present multi-step press system is designed to ensure that the blank workpieces 12 are accurately and smoothly loaded into the press-forming stations 124 one after another by means of the destacker 300 and the transfer feeder 700 and then press-formed into final products by virtue of the press 100. This helps to improve productivity and reduce production costs.

Referring again to FIG. 1, the numerically controlled leveler feeder 800 is adapted to load the coil workpiece 14 into the press 100 in a direction opposite to the loading direction of the blank workpieces 12. The uncoiler 820 of the leveler feeder 800 serves to periodically unwind the coil workpiece 14 from the supply reel 810 through the operation of the pusher 822. The coil workpiece 14 thus unwound is straightened by the leveler 830 and then loaded onto the die segment 220 of the lower die 210 placed in the last downstreammost press-forming station 124-n of the press 100. In the last press-forming station 124-n, the coil workpiece 14 is press-formed into a blank workpiece 12 by means of the die segment 220 of the lower die 210 and the die segment 260 of the upper die 250. The blank workpiece 12 obtained from the coil workpiece 14 is sequentially transferred from the last press-forming station 124- n toward the first upstreammost press-forming station 124 by means of the transfer feeder 700. While passing through the respective press-forming stations 124 arranged on the upstream side of the last press-forming station 124-n, the blank workpiece 12 is press-formed into a final product by means of the respective die segments 220 of the lower die 210 and the respective die segments 260 of the upper die 250. The final product thus obtained is unloaded from the first press-forming station 124 either manually or through the use of an unloader. Use of the leveler feeder 800 makes it possible to feed the coil workpiece 14 as well as the blank workpieces 12, which helps to optimally construct a flexible manufacturing system depending on the shape of the workpieces 10 supplied.

As is apparent from the foregoing description, the multi-step press system in accordance with one embodiment of the present invention is capable of simultaneously press-forming the workpieces placed on a plurality of press-forming stations through a single pressing stroke. The workpieces can be accurately and smoothly loaded into the respective press-forming stations one after another by means of a numerically controlled leveler feeder and a transfer feeder, thereby improving productivity and sharply reducing production costs.

Furthermore, the die segments forming an upper die and a lower die of the press die set can be readily attached and removed in a cartridge-like manner, thereby shortening the die change time, enhancing the ease of work and the interchangeability of components, helping to shorten the time period required in developing and designing a press die set, and eventually reducing the production costs.

Moreover, the multi-step press system of one embodiment of the present invention allows the workpieces to be press-formed in a blank condition or a coiled condition, thus helping to attain an optimized flexible manufacturing system.

The embodiments set forth hereinabove have been presented for illustrative purpose only and, therefore, the present invention is not limited to these embodiments. It will be understood by those skilled in the art that various changes and modifications may be made without departing from the scope of the invention defined in the claims.

What is claimed is:

1. A multi-step press system comprising:

a press including a press frame, a table provided on the press frame, the table having a standby station into which workpieces are loaded one by one and a plurality of press-forming stations in which the workpieces are sequentially press-formed, the standby station and the press-forming stations being serially arranged in an X-axis direction, and a ram provided above the table and movable along a Z-axis direction;

a press die set including a lower die attached to the table and an upper die attached to the ram, the lower die and the upper die being adapted to simultaneously press-form the workpieces placed in the press-forming stations;

a destacker provided on one side of the press for periodically loading the workpieces into the standby station one by one; and a transfer feeder provided between the table and the ram for simultaneously picking up the workpieces placed in the standby station and the press-forming stations and transferring the workpieces in a downstream direction, wherein the lower die of the press die set comprises:

a base attached to the table of the press;

plural pairs of guide rails fixedly secured to a top surface of the base and arranged at intervals in a Y-axis direction, each pair of guide rails having mutually opposing grooves;

a plurality of die segments configured to contact with the workpieces to press-form the workpieces into desired shapes, each of the die segments having a slider plate inserted into the grooves of each pair of guide rails; and a plurality of clamping units each having clamps arranged on opposite lateral sides of each pair of guide rails, the clamps being adapted to releasably clamp the slider plate of each of the die segments.

2. The multi-step press system as recited in claim 1, wherein the lower die further comprises a plurality of locators each arranged on a rear side of each pair of guide rails for aligning a corresponding one of the die segments in a predetermined position.

3. The multi-step press system as recited in claim 2, wherein the slider plate of each of the die segments has a plurality of locator holes formed in a rear end region of the slider plate and wherein each of the locators includes an actuator attached to the base of the lower die and a plurality of locator pins adapted to be displaced by the actuator and inserted into the locator holes of the slider plate.

4. A multi-step press system comprising:

a press including a press frame, a table provided on the press frame, the table having a standby station into which workpieces are loaded one by one and a plurality of press-forming stations in which the workpieces are sequentially press-formed, the standby station and the press-forming stations being serially arranged in an X-axis direction, and a ram provided above the table and movable along a Z-axis direction;

a press die set including a lower die attached to the table and an upper die attached to the ram, the lower die and the upper die being adapted to simultaneously press-form the workpieces placed in the press-forming stations;

a destacker provided on one side of the press for periodically loading the workpieces into the standby station one by one; and a transfer feeder provided between the table and the ram for simultaneously picking up the workpieces placed in the standby station and the press-forming stations and transferring the workpieces in a downstream direction, wherein the upper die of the press die set comprises:

a base attached to the ram of the press;

plural pairs of guide rails fixedly secured to a bottom surface of the base and arranged at intervals in a Y-axis direction, each pair of guide rails having mutually opposing grooves;

a plurality of die segments configured to contact with the workpieces to press-form the workpieces into desired shapes, each of the die segments having a slider plate inserted into the grooves of each pair of guide rails; and a plurality of clamping units each having clamps arranged on opposite lateral sides of each pair of guide rails, the clamps being adapted to releasably clamp the slider plate of each of the die segments.

5. The multi-step press system as recited in claim 4, wherein the upper die further comprises a plurality of locators each arranged on a rear side of each pair of guide rails for aligning a corresponding one of the die segments in a predetermined position.

6. The multi-step press system as recited in claim 5, wherein the slider plate of each of the die segments has a plurality of locator holes formed in a rear end region of the slider plate and wherein each of the locators includes an actuator attached to the base of the upper die and a plurality of locator pins adapted to be displaced by the actuator and inserted into the locator holes of the slider plate.

7. A multi-step press system comprising:

a press including a press frame, a table provided on the press frame, the table having a standby station into which workpieces are loaded one by one and a plurality of press-forming stations in which the workpieces are sequentially press-formed, the standby station and the press-forming stations being serially arranged in an X-axis direction, and a ram provided above the table and movable along a Z-axis direction;

a press die set including a lower die attached to the table and an upper die attached to the ram, the lower die and the upper die being adapted to simultaneously press-form the workpieces placed in the press-forming stations;

a destacker provided on one side of the press for periodically loading the workpieces into the standby station one by one; and a transfer feeder provided between the table and the ram for simultaneously picking up the workpieces placed in the standby station and the press-forming stations and transferring the workpieces in a downstream direction, wherein the destacker comprises:

a destacker frame;

a first stacker provided between the press frame and the destacker frame for holding the workpieces in a stacked condition;

a second stacker provided between the press frame and the destacker frame in a spaced-apart relationship with the first stacker in a Y-axis direction for holding the workpieces in a stacked condition;

a lift device provided on one side of the destacker frame, the lift device including a Z-axis carriage movable along the Z-axis direction to lift up the workpieces stacked in one of the first stacker and the second stacker, the Z-axis carriage having a pusher for pushing the workpieces in an upward direction;

a Y-axis linear motion actuator including a base plate equipped with the first stacker and the second stacker and a Y-axis carriage for carrying the base plate and making rectilinear reciprocating movement in the Y-axis direction;

an unloader mounted to a top portion of the destacker frame for receiving a given number of the workpieces from one of the first stacker and the second stacker and unloading the workpieces one by one; and a loading feeder mounted to the top portion of the destacker frame in between the standby station of the press and the unloader for feeding the workpieces unloaded by the unloader to the standby station.

8. The multi-step press system as recited in claim 7, wherein the unloader comprises:

a holding device adapted to exert a magnetic force, the holding device being mounted to the top portion of the destacker frame for receiving a given number of the workpieces from one of the first stacker and the second stacker and holding the workpieces in a stacked condition;

a sensor configured to detect presence or absence of the workpieces in the holding device, the sensor being adapted to generate a signal for causing one of the first stacker and the second stacker to move upwards if the holding device is empty; and a vacuum suction device mounted to the top portion of the destacker frame in alignment with the holding device for sucking up and unloading a first uppermost workpiece held in the holding device to bring the first workpiece to the loading feeder, wherein a second workpiece lying just below the first workpiece is separated from the first workpiece by the magnetic force of the holding device when the first workpiece is unloaded from the holding device.

9. The multi-step press system as recited in claim 8, wherein the holding device comprises:

a mounting plate attached to the top portion of the destacker frame, the mounting plate having an opening through which the workpieces are allowed to pass;

a plurality of magnetic clamping units provided with magnets and attached to a top surface of the mounting plate in such a manner as to form a retention space for receiving the workpieces;

a stopper adapted to rotate between a support position in which a lowermost workpiece is supported by the magnets of the magnetic clamping units and an open position in which the workpieces are allowed to move past the stopper; and a supporting unit attached to the top surface of the mounting plate in such a manner as to support one lateral side of each of the workpieces held in the retention space of magnetic clamping units.

10. The multi-step press system as recited in claim 8, wherein the loading feeder comprises:

a first belt conveyor mounted to the top portion of the destacker frame, the first belt conveyor having a first belt adapted to run in the X-axis direction;

a first magnetic bar provided in parallel with the first belt of the first belt conveyor, the first magnetic bar being adapted to exert a magnetic force by which the workpiece, when detached from the vacuum suction device, is stuck to the first belt of the first belt conveyor;

a second belt conveyor arranged in front of the first belt conveyor, the second belt conveyor having a second belt adapted to run in the X-axis direction; and a second magnetic bar provided in parallel with the second belt of the second belt conveyor, the second magnetic bar being adapted to exert a magnetic force by which the workpiece, when detached from the first belt of the first belt conveyor, is stuck to the second belt of the second belt conveyor.

11. A multi-step press system comprising:

a press including a press frame, a table provided on the press frame, the table having a standby station into which workpieces are loaded one by one and a plurality of press-forming stations in which the workpieces are sequentially press-formed, the standby station and the press-forming stations being serially arranged in an X-axis direction, and a ram provided above the table and movable alone a Z-axis direction;

a press die set including a lower die attached to the table and an upper die attached to the ram, the lower die and the upper die being adapted to simultaneously press-form the workpieces placed in the press-forming stations;

a destacker provided on one side of the press for periodically loading the workpieces into the standby station one by one; and a transfer feeder provided between the table and the ram for simultaneously picking up the workpieces placed in the standby station and the press-forming stations and transferring the workpieces in a downstream direction, wherein the destacker comprises:

a destacker frame;

an indexing device provided below the destacker frame, the indexing device including an indexing table and a table driver for causing the indexing table to make angular movement through an unloading position;

a plurality of stackers mounted on the indexing table in condition for movement in the Z-axis direction, each of the stackers being adapted to hold the workpieces in a stacked condition;

a lift device provided on one side of the destacker frame, the lift device including a Z-axis carriage movable along the Z-axis direction to lift up the workpieces stacked in one of the stackers, the Z-axis carriage having a pusher for pushing the workpieces in an upward direction;

an unloader mounted to a top portion of the destacker frame for receiving a given number of the workpieces from one of the stackers and unloading the workpieces one by one; and a loading feeder mounted to the top portion of the destacker frame in between the standby station of the press and the unloader for feeding the workpieces unloaded by the unloader to the standby station.

12. The multi-step press system as recited in claim 7, wherein the transfer feeder comprises:

a vacuum suction unit provided between the table of the press and the ram in condition for movement in the X-axis direction and the Z-axis direction, the vacuum suction unit being adapted to simultaneously suck up the workpieces placed in the standby station and the press-forming stations; and a robot unit mounted to the press frame for causing the vacuum suction unit to move in the X-axis direction and the Z-axis direction.

13. The multi-step press system as recited in claim 7, further comprising a numerically controlled leveler feeder provided on the other side of the press for loading a coil workpiece to a last downstreammost one of the press-forming stations, the leveler feeder including an uncoiler for unwinding the coil workpiece held by a supply reel and a leveler for straightening the coil workpiece supplied from the uncoiler and then loading the coil workpiece into the last downstreammost press-forming station.

* * * * *